US008931662B2

(12) United States Patent
Bradley

(10) Patent No.: US 8,931,662 B2
(45) Date of Patent: Jan. 13, 2015

(54) PANEL SUCH AS A METER BOX COVER

(75) Inventor: Earl Terence Bradley, Eastland, TX (US)

(73) Assignee: EBBA Iron, Inc., Eastland, TX (US)

( * ) Notice: Subject to any disclaimer, the term of this patent is extended or adjusted under 35 U.S.C. 154(b) by 738 days.

(21) Appl. No.: 12/985,009

(22) Filed: Jan. 5, 2011

(65) Prior Publication Data

US 2012/0047805 A1 Mar. 1, 2012

Related U.S. Application Data

(63) Continuation-in-part of application No. 12/868,931, filed on Aug. 26, 2010, now Pat. No. 8,672,179.

(51) Int. Cl.
*B65D 43/16* (2006.01)
*E05D 7/10* (2006.01)

(52) U.S. Cl.
CPC ..... *E05D 7/1005* (2013.01); *E05Y 2900/132* (2013.01)
USPC ..... 220/848; 220/254.3; 220/484

(58) Field of Classification Search
CPC .... B65D 43/16; B65D 43/163; B65D 43/164; B65D 43/165; E05D 7/1005; E05Y 2900/132
USPC ..... 220/254.3, 484, 843, 848; 49/399, 506
See application file for complete search history.

(56) References Cited

U.S. PATENT DOCUMENTS

| | | | | |
|---|---|---|---|---|
| 1,925,635 | A | 9/1933 | Hartley | |
| 2,883,853 | A * | 4/1959 | Forni | 52/21 |
| 3,447,169 | A | 6/1969 | Watson | |
| D233,880 | S | 12/1974 | Swenson et al. | |
| D258,415 | S | 3/1981 | DeStepheno | |
| D275,172 | S | 8/1984 | Kwan | |
| 5,327,682 | A * | 7/1994 | Holtz | 49/463 |
| D419,417 | S | 1/2000 | Kane | |
| 6,116,813 | A | 9/2000 | Pate | |
| 6,209,172 | B1 | 4/2001 | Bradley | |
| D443,198 | S | 6/2001 | Snyder | |
| D500,441 | S | 1/2005 | Senn | |
| D510,253 | S | 10/2005 | Twomey | |
| D524,141 | S | 7/2006 | Kwan | |
| D525,856 | S | 8/2006 | Kwan | |
| D573,821 | S | 7/2008 | Rubin et al. | |
| D575,312 | S | 8/2008 | McDaniel et al. | |
| D578,872 | S | 10/2008 | Healy | |
| D615,384 | S | 5/2010 | Ross | |
| D622,575 | S | 8/2010 | Li | |
| D627,690 | S | 11/2010 | Madden | |
| 2003/0145429 | A1 | 8/2003 | Twomey | |
| 2003/0178425 | A1 | 9/2003 | McKinnon | |

OTHER PUBLICATIONS

Web page: www.diyanswerguy.com/tools/plumbing/water-meter-bos.jpg; Feb. 4, 2010 (1 page).

Notice of Allowance mailed Dec. 23, 2010, by the USPTO, in connection with U.S. Appl. No. 29/368,605.

U.S. Appl. No. 29/368,605, filed Aug. 26, 2010, Bradley.

(Continued)

*Primary Examiner* — Fenn Mathew

*Assistant Examiner* — James N Smalley

(74) *Attorney, Agent, or Firm* — Haynes and Boone, LLP

(57) ABSTRACT

A panel, such as a water meter box cover or another type of meter box cover, according to which an access door is hingedly or pivotally coupled to the panel.

10 Claims, 24 Drawing Sheets

(56) References Cited

OTHER PUBLICATIONS

U.S. Appl. No. 12/868,931, filed Aug. 26, 2010, Bradley.
U.S. Appl. No. 29/382,607, filed Jan. 5, 2011, Bradley.
Notice of Allowance mailed Jun. 26, 2013, by the USPTO in U.S. Appl. No. 12/868,931.
Office Action mailed Jan. 3, 2013, by the USPTO in U.S. Appl. No. 12/868,931.
Office Action mailed Jul. 13, 2012, by the USPTO in U.S. Appl. No. 12/868,931.

* cited by examiner

PANEL SUCH AS A METER BOX COVER

CROSS REFERENCE TO RELATED APPLICATIONS

This application is a continuation-in-part of U.S. utility patent application Ser. No. 12/868,931, filed Aug. 26, 2010, the entire disclosure of which is incorporated herein by reference.

This application is related to U.S. utility patent application Ser. No. 12/868,931, filed Aug. 26, 2010; and U.S. design patent application Ser. No. 29/368,605, filed Aug. 26, 2010, the entire disclosures of which are incorporated herein by reference.

BACKGROUND

This disclosure relates in general to a panel, such as a water meter box cover or another type of meter box cover, and an access door that is hingedly or pivotally coupled to the panel.

DETAILED DESCRIPTION

Figure 1A:
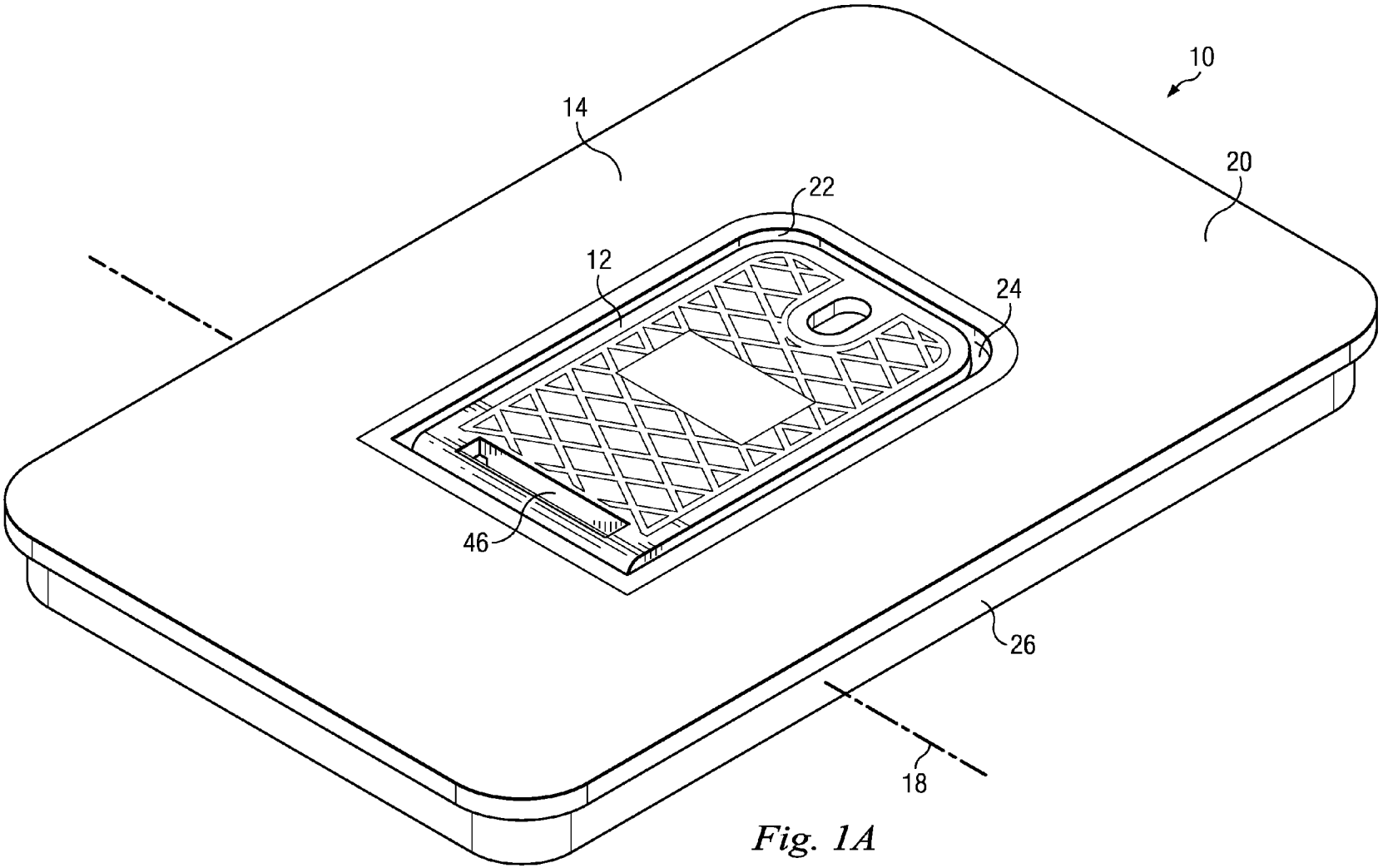
FIG. 1A is a perspective view of an apparatus according to an exemplary embodiment, the apparatus including an access door, a panel such as a meter box cover, and a pin element.
Figure 1B:
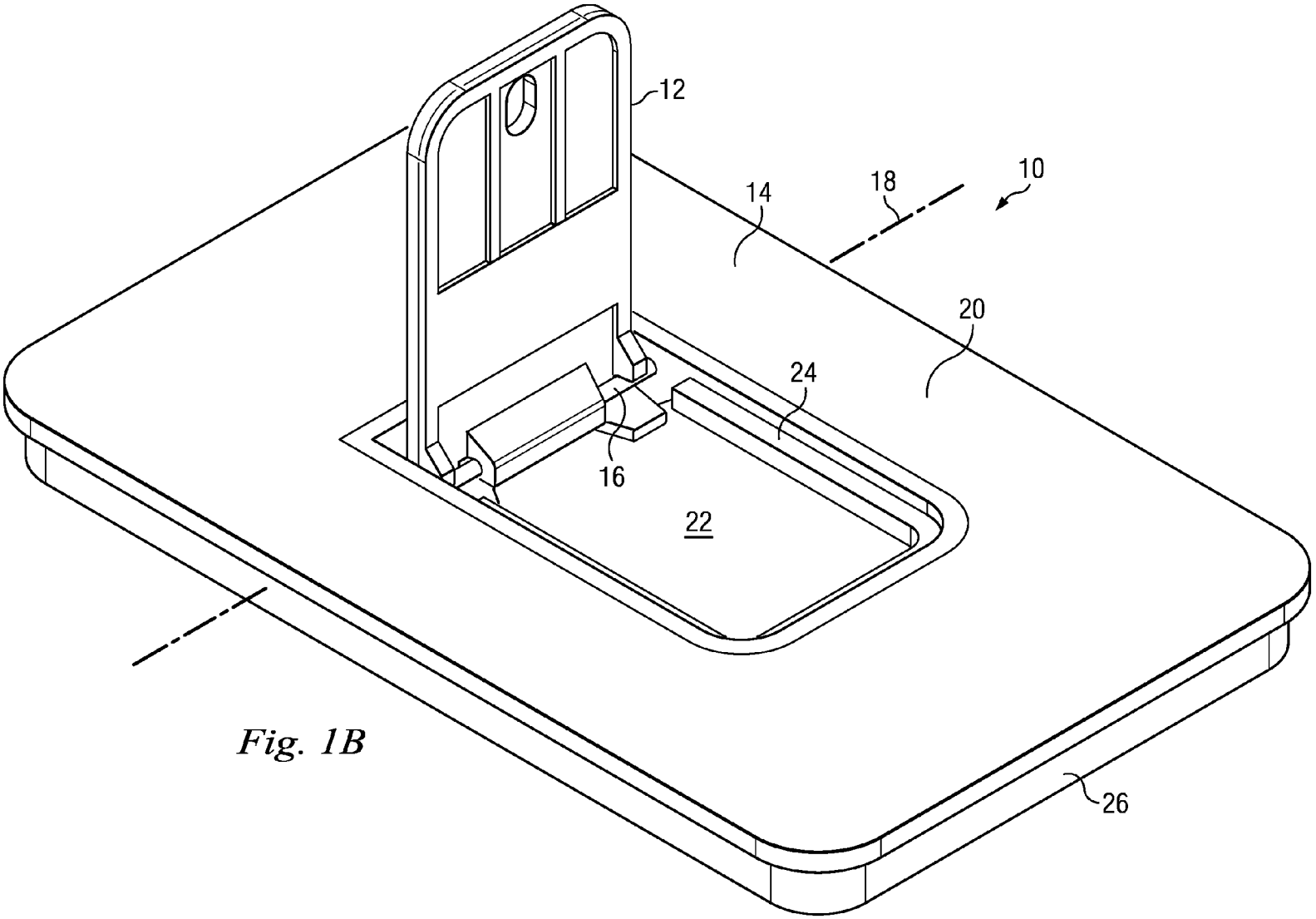
FIG. 1B is another perspective view of the apparatus of FIG. 1A, but depicts the access door in another operational position.

In an exemplary embodiment, as illustrated in FIGS. 1A and 1B, an apparatus is generally referred to by the reference numeral 10 and includes a generally rectangular access door 12, which is hingedly or pivotally coupled to a panel 14 via a pin element 16 (shown in FIG. 1B). A pivot axis 18 is defined in part by the access door 12. Under conditions to be described in detail below, the access door 12 is adapted to pivot, relative to the panel 14, about the pivot axis 18 and between a closed position shown in FIG. 1A and an open position shown in FIG. 1B. In an exemplary embodiment, the panel 14 is a meter box cover such as, for example, a water meter box cover. In an exemplary embodiment, each of the access door 12 and the panel 14 is formed of cast metal, such as ductile iron. In several exemplary embodiments, instead of, or in addition to cast metal, the access door 12 and/or the panel 14 is formed of one or more other materials such as, for example, one or more thermoplastic or thermoset materials.

The panel 14 includes a plate or wall 20 and a generally rectangular opening 22 formed therethrough. At least a portion of the access door 12 is disposed in the opening 22, regardless of the pivot position of the access door 12 relative to the panel 14. A generally U-shaped internal shoulder 24 is disposed within the opening 22, and faces a direction so that the access door 12 is adapted to engage or nearly engage the shoulder 24 when the access door 12 is in the closed position shown in FIG. 1A. A peripheral flange 26 depends from the wall 20.

Figure 2A:
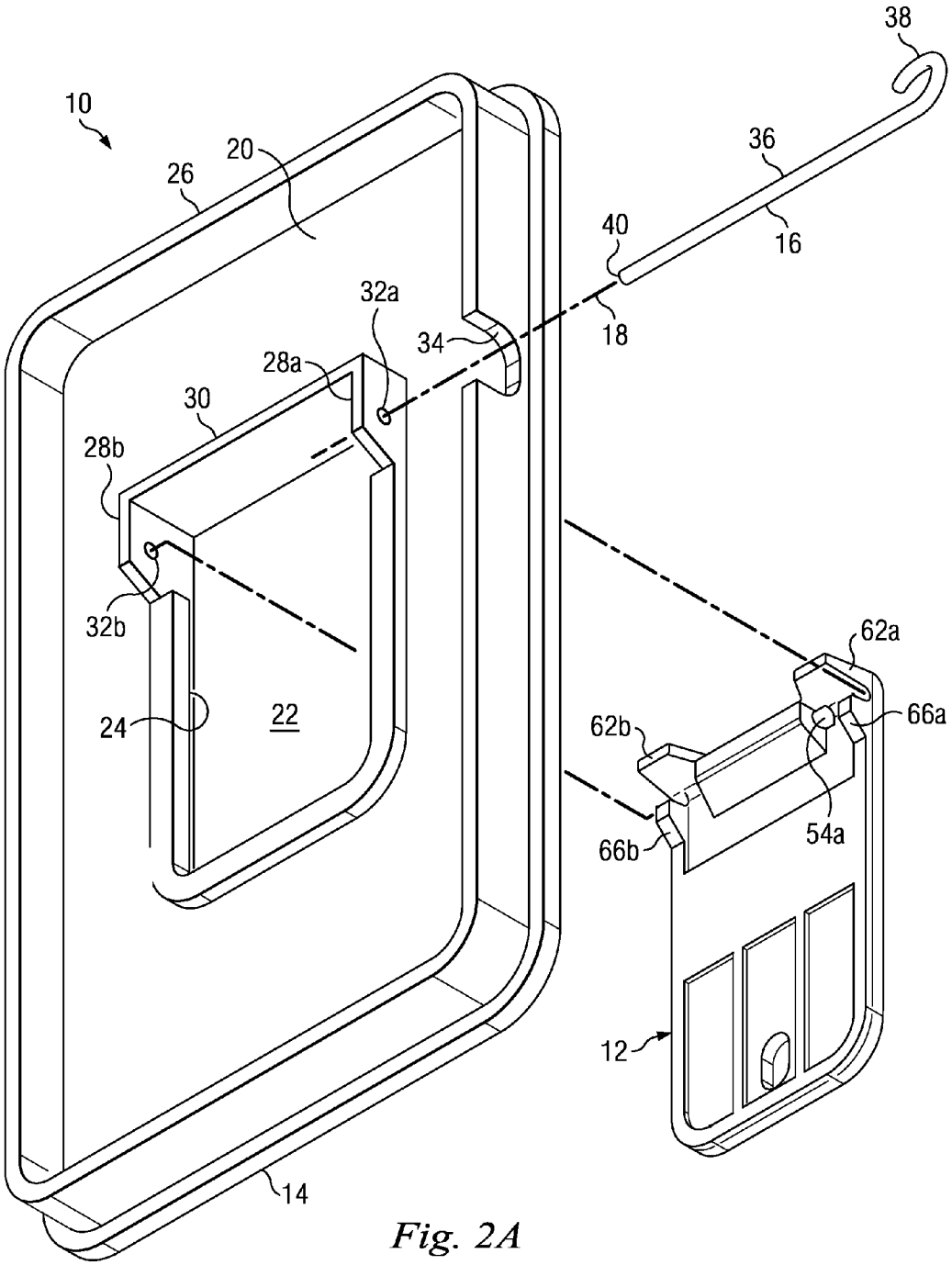
FIG. 2A is an exploded view of the apparatus of FIGS. 1A and 1B.
Figure 2B:
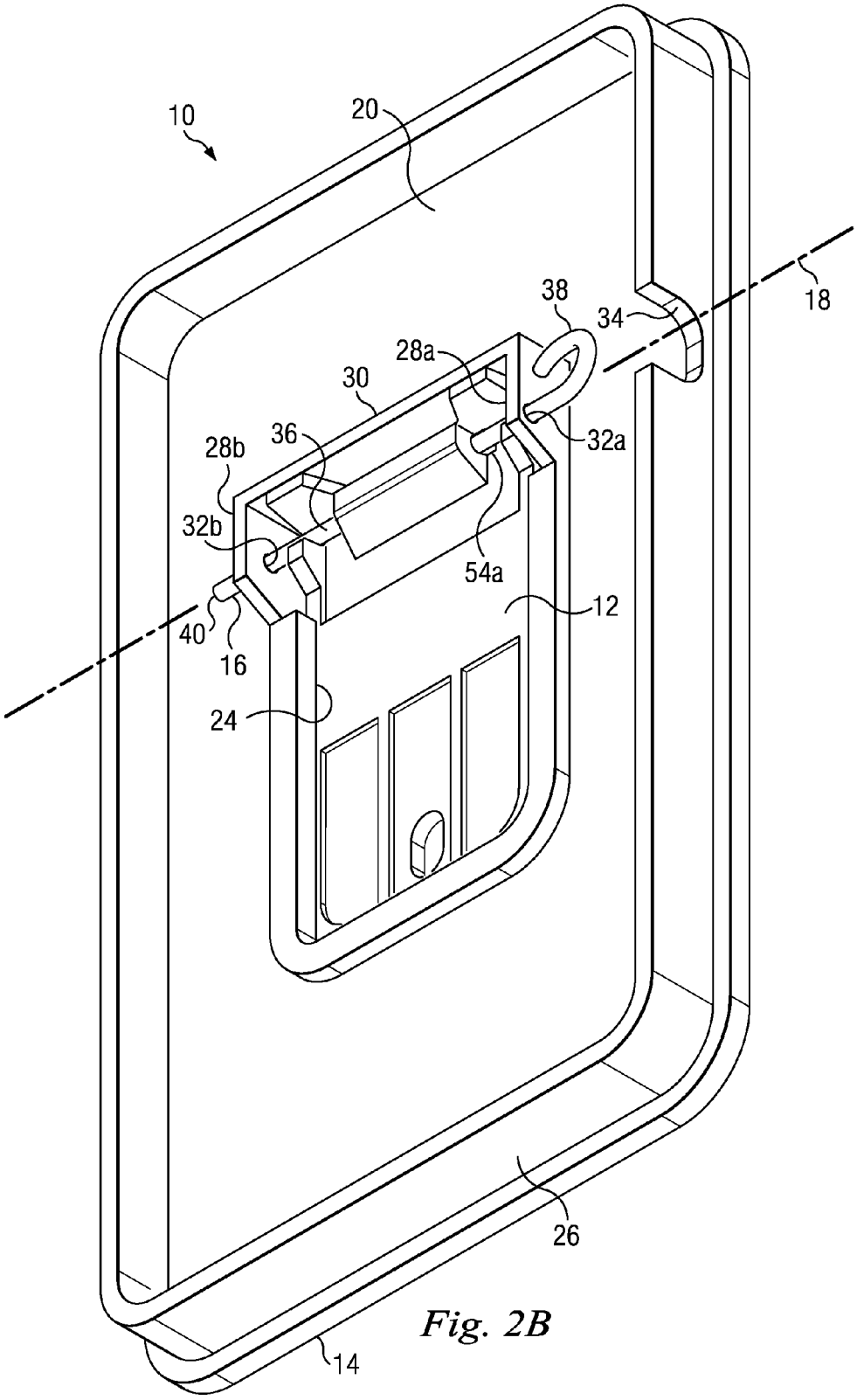
FIG. 2B is a view similar to that of FIG. 2A, but depicts the apparatus of FIGS. 1A and 1B in an unexploded condition.
Figure 3:
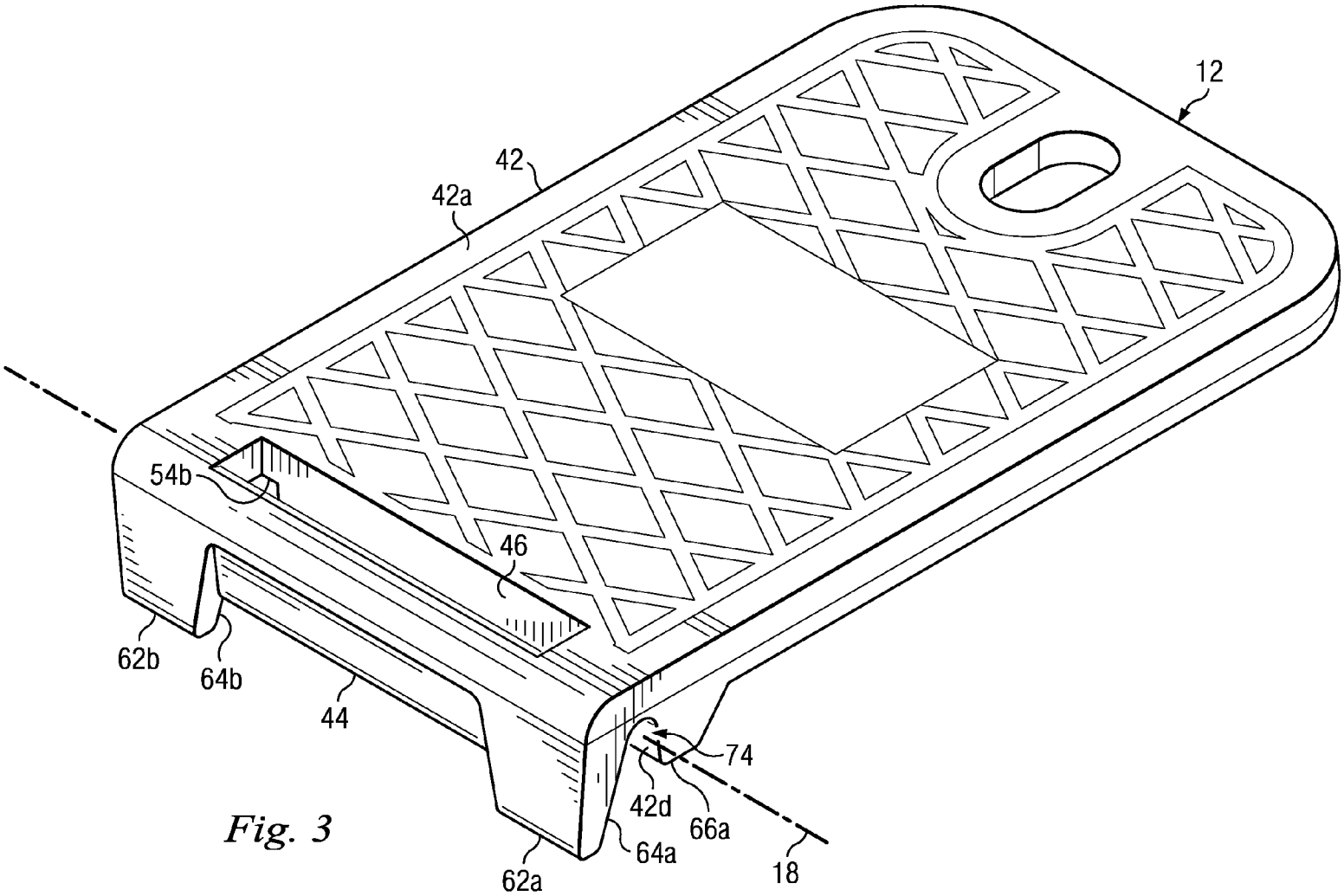
FIG. 3 is a perspective view of the access door of FIGS. 1A, 1B, 2A and 2B, according to an exemplary embodiment.

In an exemplary embodiment, as illustrated in FIGS. 2A and 2B with continuing reference to FIGS. 1A and 1B, the panel 14 further includes opposed walls 28*a* and 28*b*, which are aligned with opposed edges of the opening 22, respectively, and extend away from the wall 20 in a direction generally opposite the direction which the internal shoulder 24 faces. A wall 30 is also aligned with another edge of the opening 22, and extends between the walls 28*a* and 28*b*. Axially-aligned openings 32*a* and 32*b* are formed through the opposed walls 28*a* and 28*b*, respectively. A notch 34 is formed in the flange 26, and is axially aligned with the openings 32*a* and 32*b*. The notch 34 and the openings 32*a* and 32*b* are generally coaxial with the pivot axis 18.

The pin element 16 includes a pin or rod portion 36, a hooked end portion 38, and a non-hooked end portion 40 that is opposite the hooked end portion 38. The rod portion 36, the non-hooked end portion 40, and the openings 32*a* and 32*b*, are each sized so that the rod portion 36 is permitted to extend through the openings 32*a* and 32*b*, under conditions to be described below. The notch 34 is sized to permit the pin element 16, including the hooked end portion 38, to pass through the notch 34, under conditions to be described below. In an exemplary embodiment, the pin element 16 is formed of a wire having a diameter that permits the rod portion 36 to extend through the openings 32*a* and 32*b*. In an exemplary embodiment, the pin element 16 is formed of ¼-inch wire or another size of wire. In an exemplary embodiment, instead of, or in addition to a wire, the pin element 16 is, or includes, a fastener.

In an exemplary embodiment, as illustrated in FIGS. 3-11 with continuing reference to FIGS. 1A, 1B, 2A and 2B, the access door 12 includes a plate 42 defining parallel-spaced sides 42*a* and 42*b*. A recess 43 is formed in the side 42*b*, and defines a horizontally-extending surface 42*c* on the side 42*b* of the plate 42. A ridge 44 extends from the horizontally-extending surface 42*c* and along the side 42*b*, and includes opposing end portions 44*a* and 44*b*. Angularly-extending end faces 44*c* and 44*d* are defined by the opposing end portions 44*a* and 44*b*, respectively, so that the ridge 44 is longest at a base 44*e* thereof which extends along the horizontally-extending surface 42*c* on the side 42*b* of the plate 42, as most clearly shown in FIGS. 4 and 10. A channel 46 is formed in the side 42*a* of the plate 42, and extends into the ridge 44 and axially therealong. An axially-extending internal concave surface 48 of the ridge 44 is defined by the channel 46. Surfaces 50*a* and 50*b* are also defined by the channel 46, and extend angularly inward and towards each other from the side 42*a* of the plate 42. The angularly-extending surface 50*b* is spaced from the angularly-extending surface 50*a* in a direction 52 (shown in FIGS. 9 and 11) that is generally perpendicular to the pivot axis 18. The angularly-extending surfaces 50*a* and 50*b* are part of the plate 42 and the ridge 44. The concave surface 48 joins the distal ends of the surfaces 50*a* and 50*b* so that the surfaces 48, 50*a* and 50*b* are generally continuous.

Figure 4:
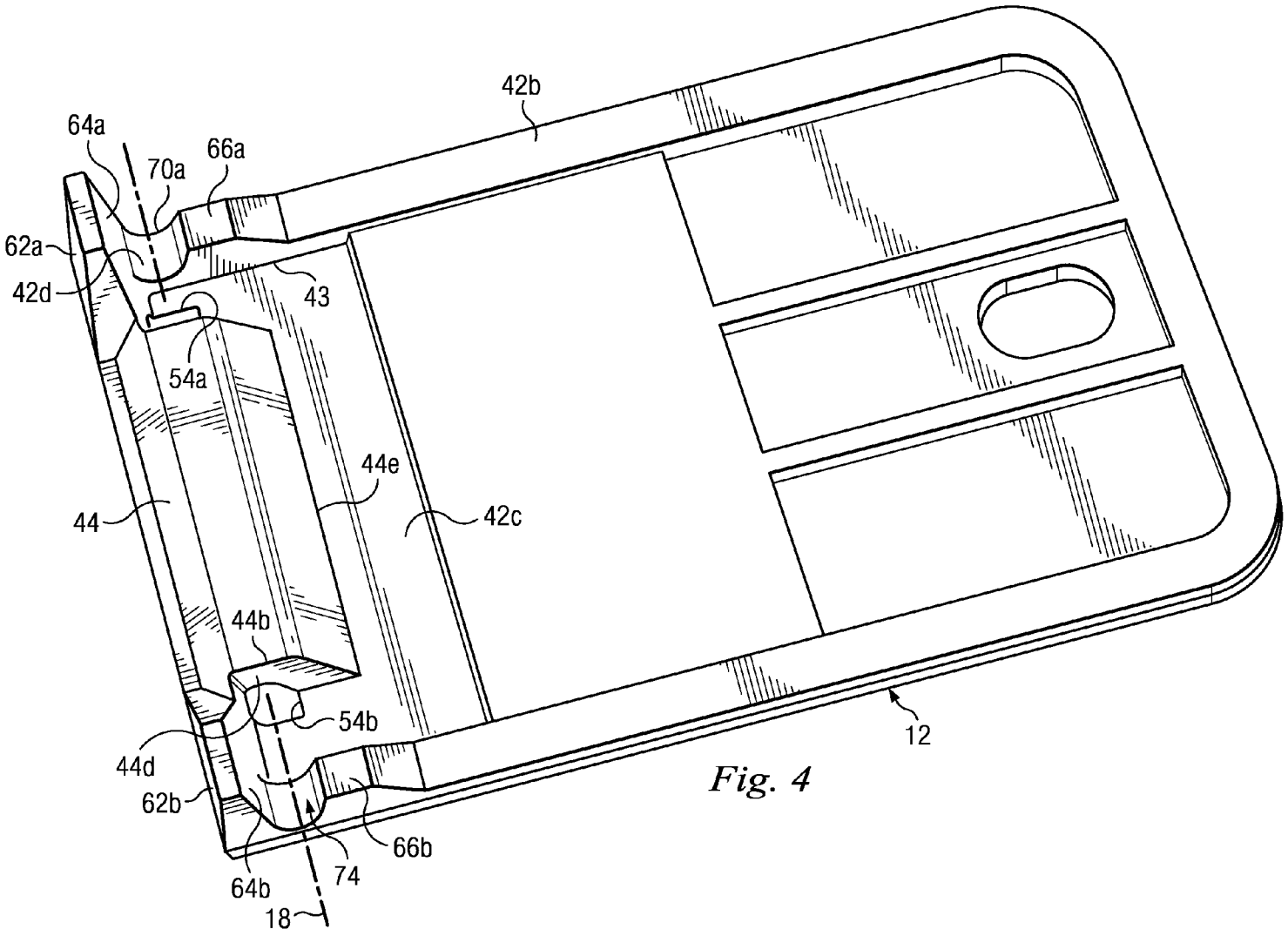
FIG. 4 is another perspective view of the access door of FIG. 3.
Figure 5:
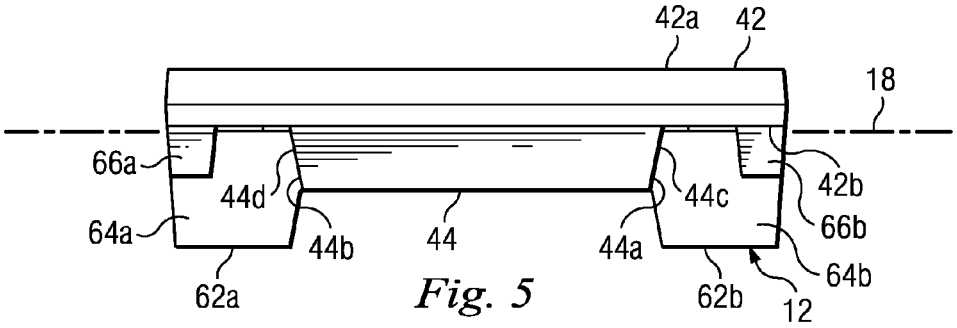
FIG. 5 is a front elevational view of the access door of FIG. 3.
Figure 9:
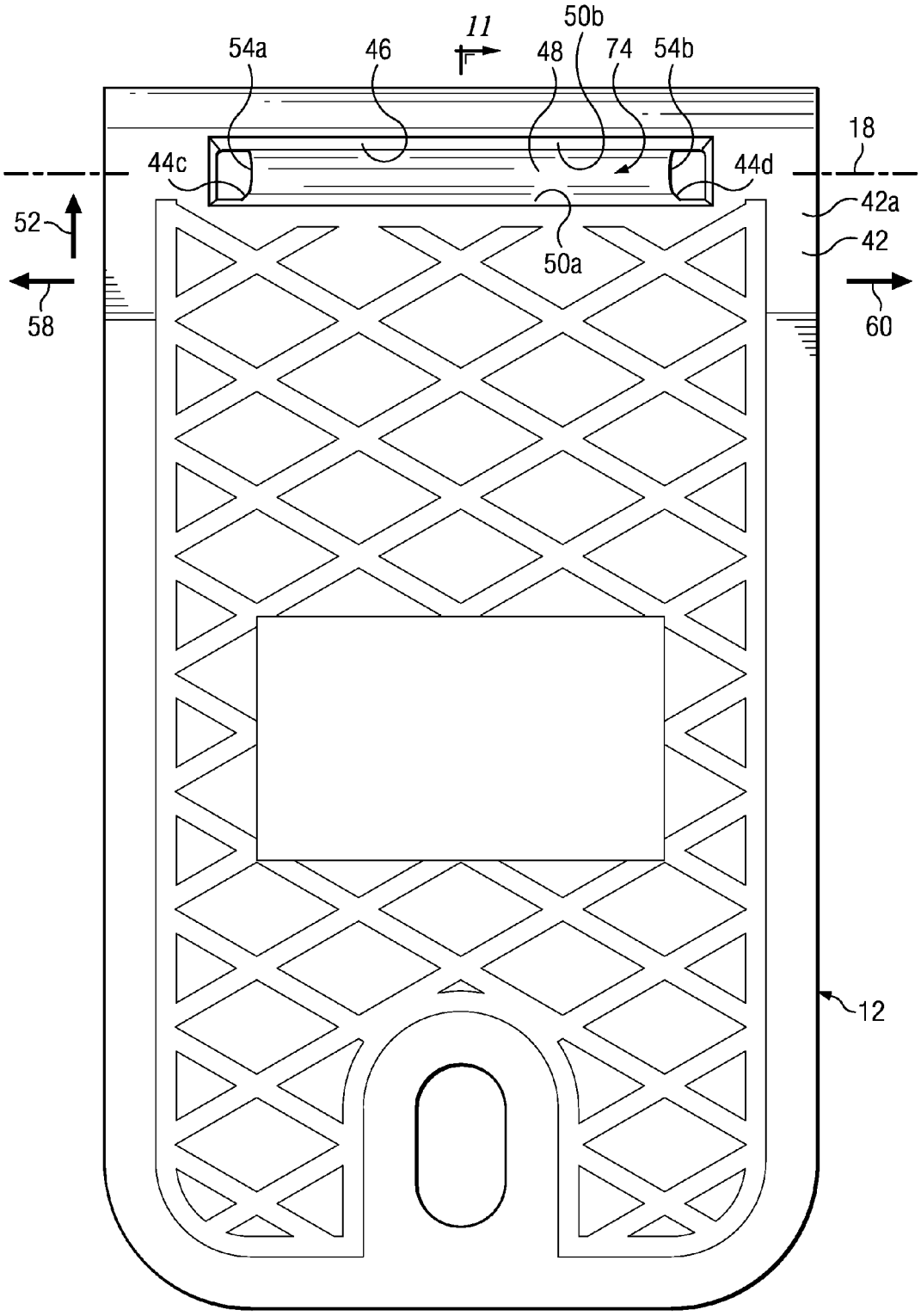
FIG. 9 is a top plan view of the access door of FIG. 3.
Figure 10:
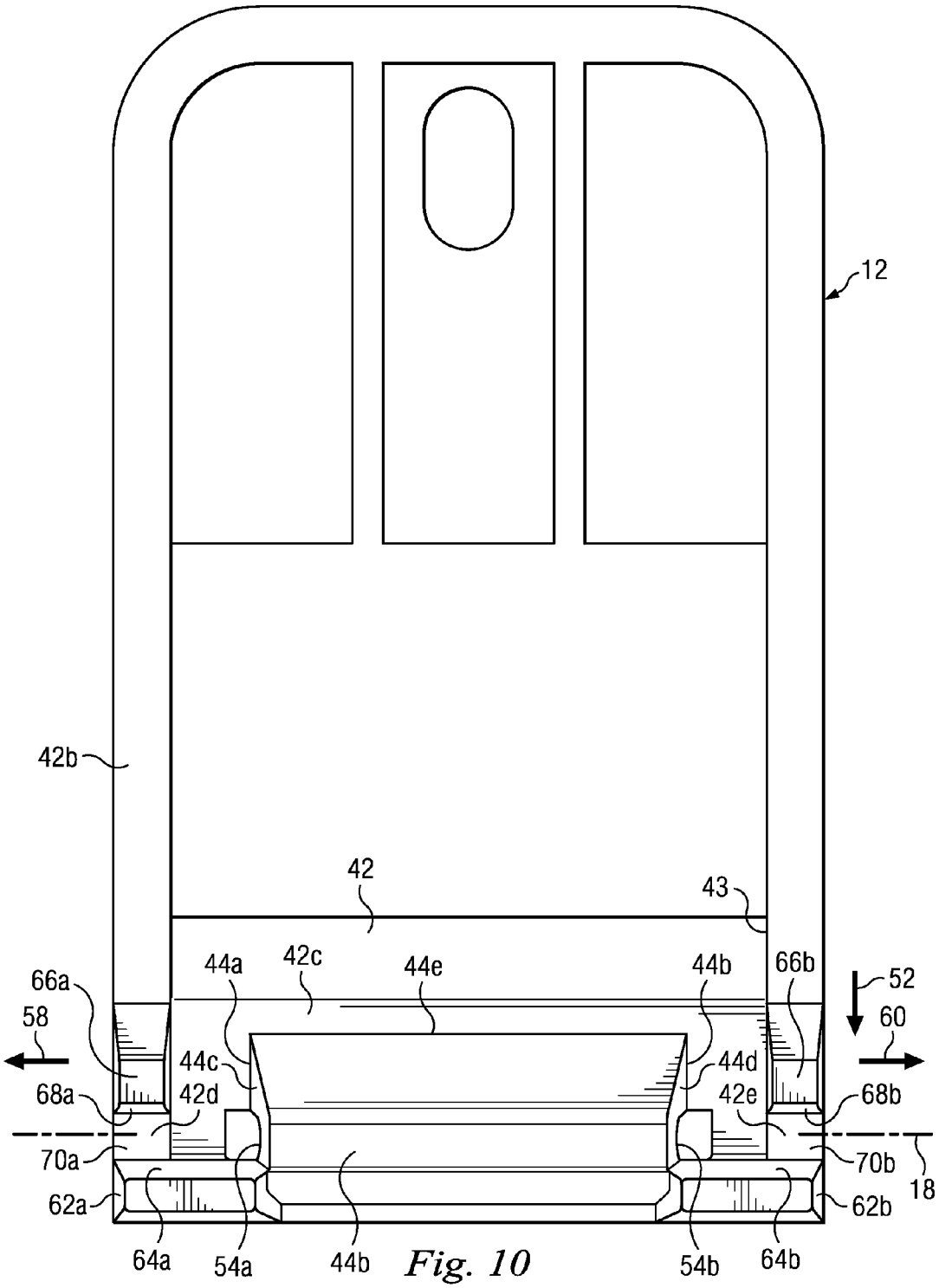
FIG. 10 is a bottom plan view of the access door of FIG. 3.

Opposing openings 54*a* and 54*b* are formed through the plate 42, and further through the opposing end portions 44*a* and 44*b*, respectively, of the ridge 44, as clearly shown in FIGS. 4, 9 and 10. More particularly, the opening 54*a* extends through the plate 42 and the end portion 44*a* in a direction 56 (shown FIG. 11) that is generally perpendicular to the pivot axis 18. The opening 54*a* also extends from the channel 46 and through the end portion 44*a* of the ridge 44 in a direction 58 (shown in FIGS. 9 and 10), which is generally parallel to the pivot axis 18. Similarly, the opening 54*b* extends through the plate 42 and the end portion 44*b* in the direction 56, and also extends from the channel 46 and through the end portion 44*b* of the ridge 44 in a direction 60 (shown in FIGS. 9 and 10), which is generally parallel to the pivot axis 18.

Opposing tabs 62*a* and 62*b* extend from the side 42*b* of the plate 42. The tabs 62*a* and 62*b* defines angularly-extending surfaces 64*a* and 64*b*, respectively. The surface 64*a* shares an edge with the end face 44*c* of the ridge 44, and is adjacent a portion of the opening 54*a*. Similarly, the surface 64*b* shares an edge with the end face 44*d* of the ridge 44, and is adjacent a portion of the opening 54*b*. At least the great majority the ridge 44 is axially positioned between the tabs 62*a* and 62*b*. Opposing ears 66*a* and 66*b* extend from the side 42*b* of the plate 42. The ears 66*a* and 66*b* define angularly-extending surfaces 68*a* and 68*b*, respectively. The surface 64*a* of the tab 62*a* is spaced from the surface 68*a* of the ear 66*a* in the direction 52. Likewise, the surface 64*b* of the tab 62*b* is spaced from the surface 68*b* of the ear 66*b* in the direction 52.

Notches 70*a* and 70*b* are formed in the second side 42*b* of the plate 42. The notches 70*a* and 70*b* define axially-aligned concave surfaces 42*d* and 42*e*, respectively, of the plate 42. The concave surface 42*d* extends between the surfaces 64*a* and 68*a*. Likewise, the concave surface 42*e* extends between the surfaces 64*b* and 68*b*. At least respective portions of the concave surfaces 42*d* and 42*e* are spaced from the concave surface 48 of the ridge 44 in a direction 72 (shown in FIG. 11), which is generally perpendicular to the pivot axis 18 and opposite to the direction 56. The concave surface 42*d* is axially spaced from the concave surface 48 in the direction 58 along the pivot axis 18. Similarly, the concave surface 42*e* is axially spaced from the concave surface 48 in the direction 60 along the pivot axis 18. As a result, the concave surface 48 is axially positioned between the concave surfaces 42*d* and 42*e*.

The surface 42*c* of the plate 42 is spaced from the concave surface 48 of the ridge 44 in the direction 72. The concave surface 48 is axially positioned between respective portions of the surface 42*c*, with one portion extending axially between the opening 54*a* and the notch 70*a*, and the other portion extending axially between the opening 54*b* and the notch 70*b*.

Figure 6:
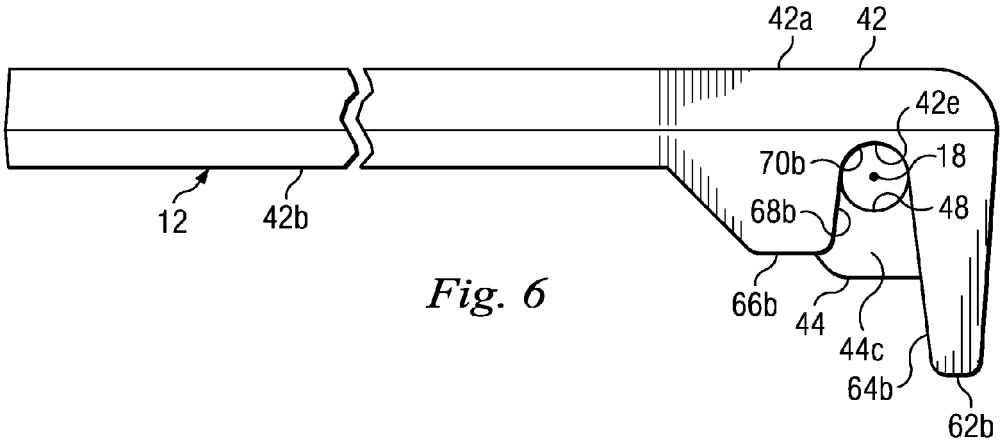
FIG. 6 is a right side elevational view of the access door of FIG. 3.
Figure 7:
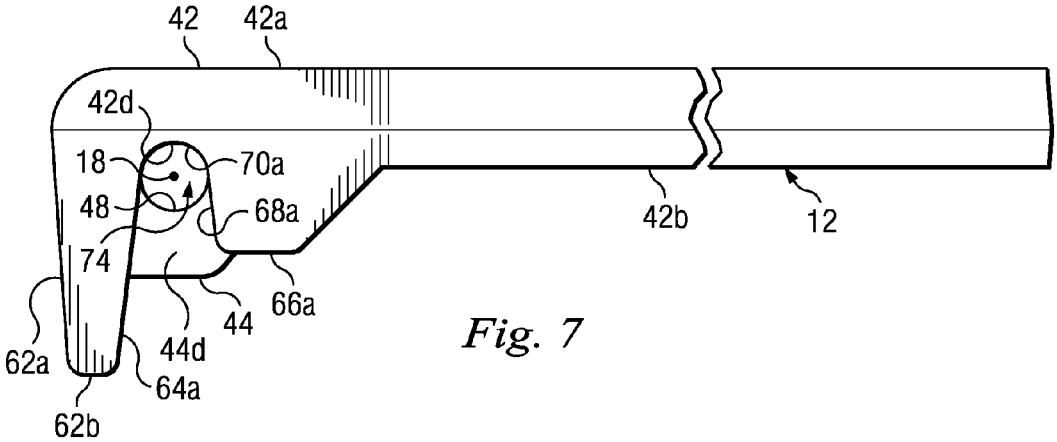
FIG. 7 is a left side elevational view of the access door of FIG. 3.
Figure 8:
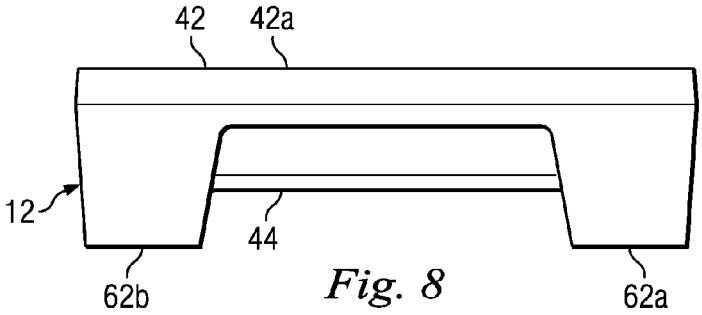
FIG. 8 is a rear elevational view of the access door of FIG. 3.
Figure 11:
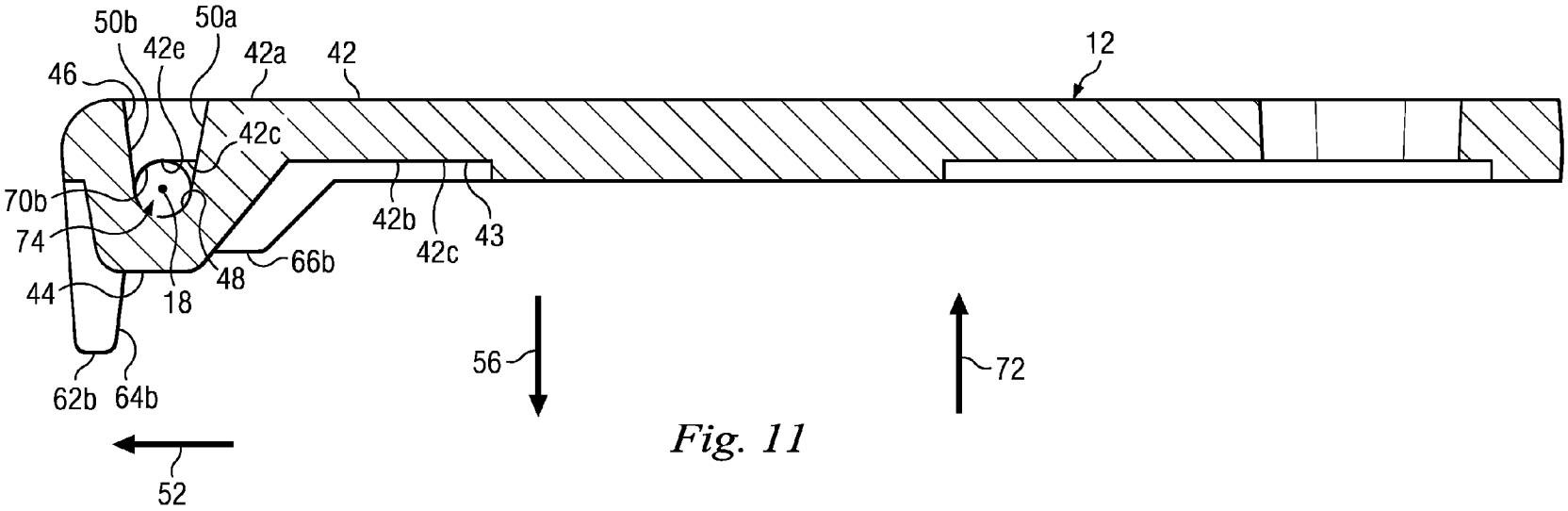
FIG. 11 is a sectional view of the access door of FIG. 3 taken along line 11-11 of FIG. 9.

As most clearly shown in FIGS. 6 and 11, the concave surfaces 42*e* and 48 are spaced from one another, in either the direction 56 or 72, so that their respective centers of curvature lie generally along the pivot axis 18. As a result, the concave surfaces 42*e* and 48 are vertically positioned, relative to one another, so that the surfaces 42*e* and 48 would form a generally circular cross section with the pivot axis 18 generally at its center, but for the axial spacing between the surfaces 42*e* and 48 along the pivot axis 18. Likewise, as shown in FIG. 7, the concave surfaces 42*d* and 48 are vertically positioned, relative to one another, so that the surfaces 42*d* and 48 would form a generally circular cross section with the pivot axis 18 generally at its center, but for the axial spacing between the surfaces 42*d* and 48 along the pivot axis 18.

An axially-extending passage 74 is defined by at least the concave surfaces 42*d*, 48 and 42*e*, and is generally coaxial with the pivot axis 18. The passage 74 includes the notch 70*a*, the opening 54*a*, the channel 46, the opening 54*b* and the notch 70*b*.

In an exemplary embodiment, the access door 12 is integrally formed and thus the plate 42, the ridge 44, the tabs 62 and 62*b*, and the ears 66*a* and 66*b*, are integrally formed. In an exemplary embodiment, the access door 12 is a casting and thus is integrally formed of cast metal, such as ductile iron. In several exemplary embodiments, instead of, or in addition to cast metal, the access door 12 is integrally formed of one or more other materials such as, for example, one or more thermoplastic or thermoset materials.

In an exemplary embodiment, with continuing reference to FIGS. 1A-11, to place the apparatus 10 in its assembled condition as shown in FIGS. 1A, 1B and 2B, the access door 12 is positioned, relative to the panel 14, so that: each of the tabs 62*a* and 62*b* of the access door 12 is adjacent the wall 30 of the panel 14, the ears 66*a* and 66*b* are adjacent the walls 28*a* and 28*b*, respectively, and the axially-extending passage 74 is axially positioned between, and aligned with, the axially-aligned openings 32*a* and 32*b*. The pin element 16 is passed through the notch 34 so that the non-hooked end portion 40 is inserted through the axially-aligned opening 32*a*, the passage 74 and the opening 32*b*. The hooked end portion 38 of the pin element 16 prevents the pin element 16 from passing completely through the opening 32*a*. As a result, the rod portion 36 of the pin element 16 extends through the opening 32*a*, the passage 74, and the opening 32*b*, thereby hingedly or pivotally coupling the access door 12 to the panel 14. The rod portion 36, the passage 74 and the openings 32*a* and 32*b* are all generally coaxial with the pivot axis 18.

In operation, in an exemplary embodiment, with continuing reference to FIGS. 1A-11, after the apparatus 10 has been placed in its assembled condition as described above, the access door 12 pivots, relative to the panel 14, about the pivot axis 18. The access door 12 pivots between the closed position shown in FIG. 1A and the open position shown in FIG. 1B. When the access door 12 is in the closed position shown in FIG. 1A, the side 42*b* of the plate 42 engages or nearly engages the shoulder 24 and the tabs 62*a* and 62*b* engage or nearly engage the wall 30, thereby resisting any further pivoting of the access door 12 in a clockwise direction, as viewed in FIGS. 1A and 1B, after the access door 12 has been placed in the closed position shown in FIG. 1A. When the access door 12 is in the open position shown in FIG. 1B, the side 42*a* of the plate 42 engages or nearly engages the panel 14 at the edge of the opening 22 that is aligned with the wall 30, thereby resisting any further pivoting of the access door 12 in a counterclockwise direction, as viewed in FIGS. 1A and 1B.

During the pivoting of the access door 12 relative to the panel 14, the respective shapes of the concave surfaces 48, 42*d* and 42*e* minimize any resistance to the pivoting of the access door 12 about the rod portion 36 of the pin element 16, thereby facilitating the pivoting of the access door 12. Further, the positioning of the respective centers of curvature of the concave surfaces 42*d*, 42*e* and 48 along the pivot axis 18 minimizes any resistance to the pivoting of the access door 12 about the rod portion 36 of the pin element 16, thereby facilitating the pivoting of the access door 12.

In several exemplary embodiments, before, during and/or after the above-described exemplary operation of the apparatus 10, the extension of the pin element 16 through the opening 32*a*, the passage 74 and the opening 32*b*, maintains the pivotal coupling between the access door 12 and the panel 14. For example, the extension of the pin element 16 between the surfaces 50*a* and 50*b* resists any movement of the access door 12, relative to the pin element 16 and thus the panel 14, in the direction 52 or a direction opposite thereof, regardless of the pivot position of the access door 12. For another example, the extension of the pin element 16 between the surfaces 64*a* and 68*a*, and between the surfaces 64*b* and 68*b*, resists any movement of the access door 12, relative to the pin element 16 and thus the panel 14, in the direction 52 or a direction opposite thereof, regardless of the pivot position of the access door 12. For still another example, the extension of the pin element 16 between the concave surface 48 and the concave surfaces 42*d* and 42*e* resists any movement of the access door 12, relative to the pin element 16 and thus the panel 14, in either the direction 56 or the direction 72, regardless of the pivot position of the access door 12. For still yet another example, if the concave surfaces 42*d* and 42*e* were omitted in an exemplary embodiment, the extension of the pin element 16 between the concave surface 48 and the respective portions of the surface 42*c* adjacent the openings 54*a* and 54*b* would resist any movement of the access door 12, relative to the pin element 16 and thus the panel 14, in either the direction 56 or the direction 72, regardless of the pivot position of the access door 12.

Figure 12:
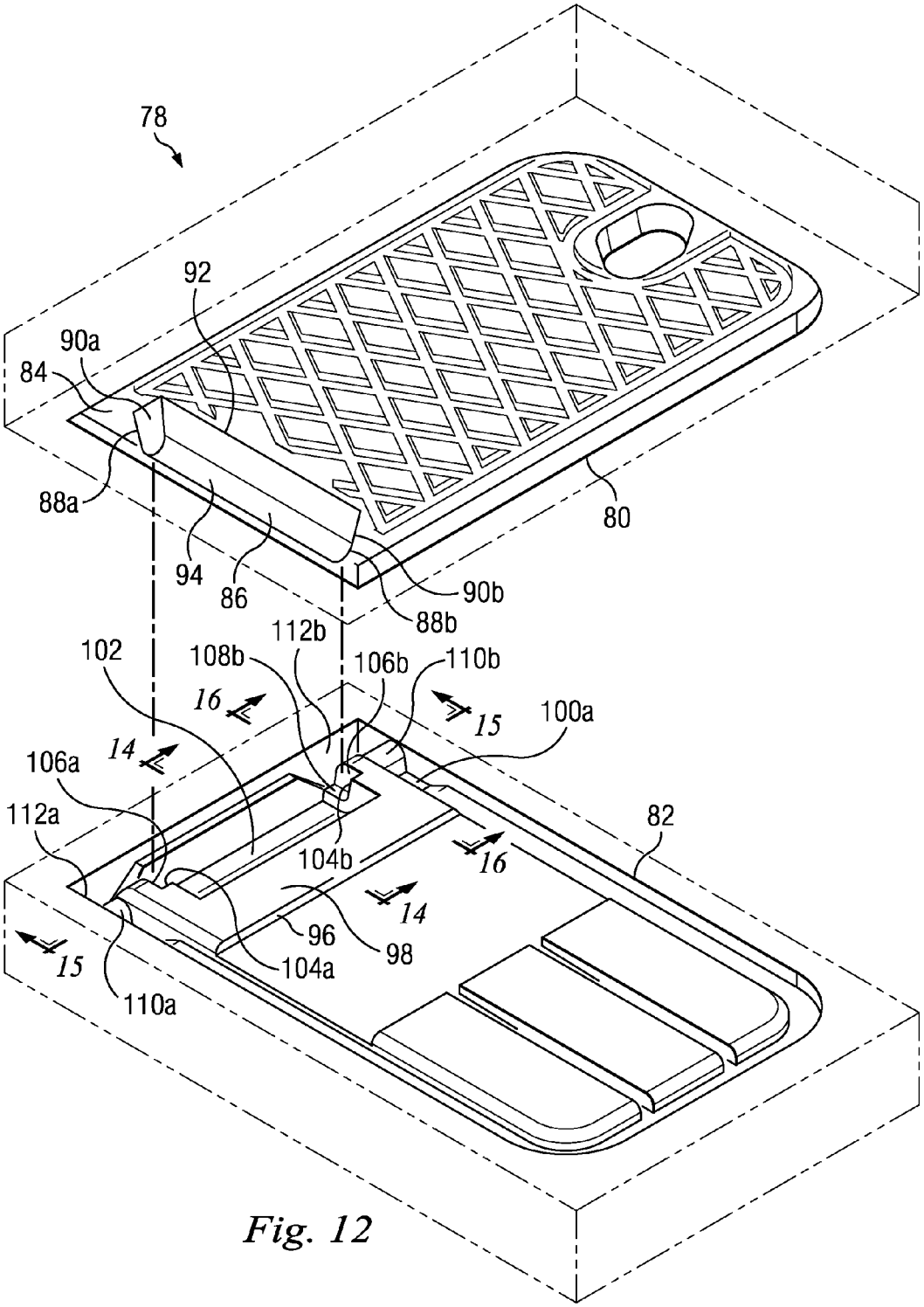
FIG. 12 is a perspective view of a horizontally-parted mold that is used to manufacture the access door of FIGS. 1A-11, the mold including upper and lower halves, according to an exemplary embodiment.
Figure 13:
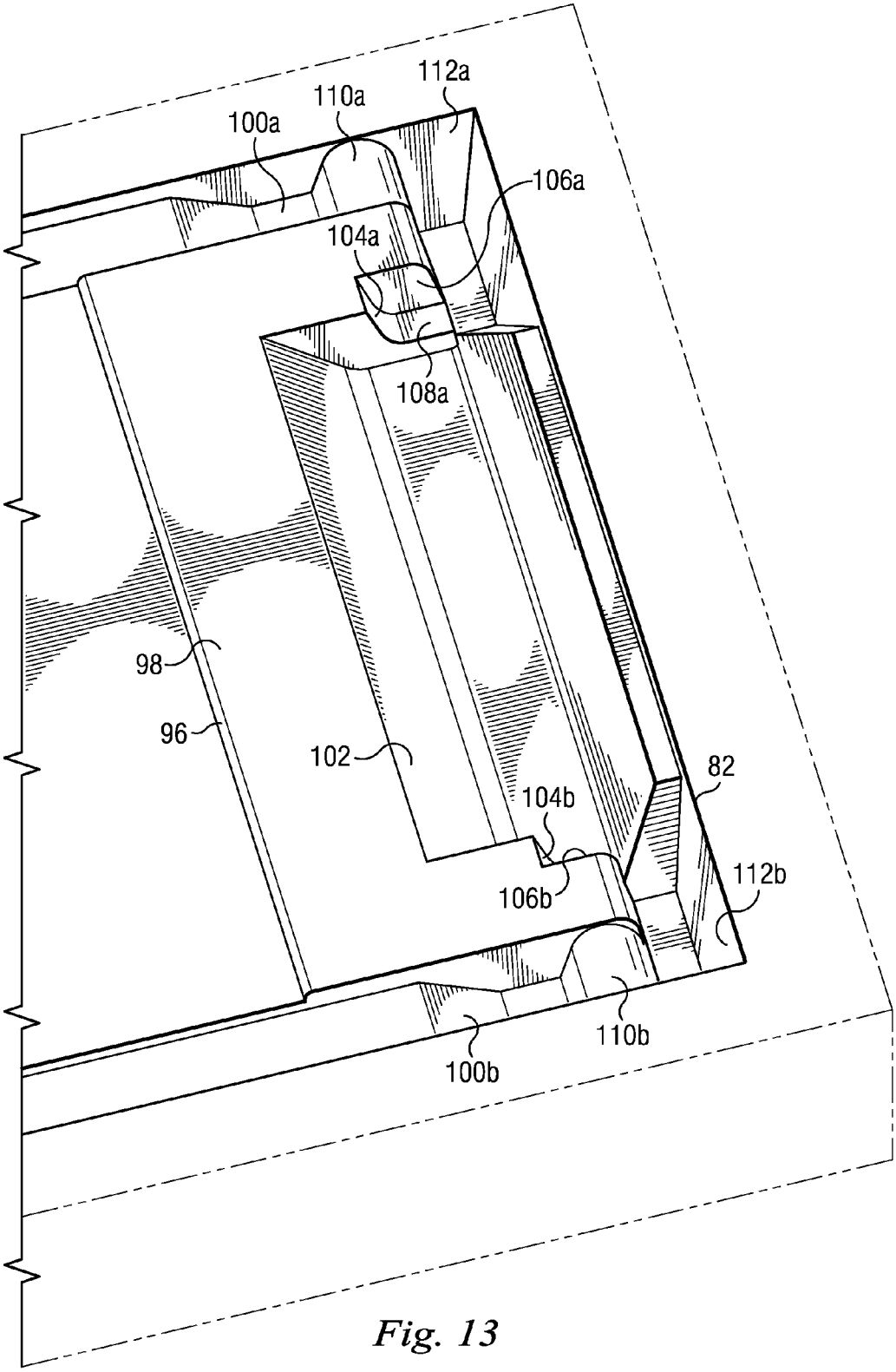
FIG. 13 is a perspective view of a portion of the lower half of the mold of FIG. 12, according to an exemplary embodiment.

In an exemplary embodiment, as illustrated in FIGS. 12 and 13 with continuing reference to FIGS. 1A-11, a horizontally-parted mold is generally referred to by the reference numeral 78 and includes an upper part, such as an upper half or cope 80, and a lower part, such as a lower half or drag 82. The mold 78 is used to manufacture the access door 12 of FIGS. 1A-11. As shown in FIGS. 12 and 13, the mold 78 does not include any cores such as, for example, hinge tubes or other cores, therein. In several exemplary embodiments, in addition to the cope 80 and the drag 82, the mold 78 includes, and/or employs, one or more gates, runner systems, etc., but does not include any cores, such as hinge tubes or other cores, therein. The broken line illustrations in FIGS. 12 and 13, and FIGS. 14-16 discussed below, indicate that the mold 78 includes additional structure other than the cope 80 and the drag 82.

The cope 80 includes a horizontally-extending surface 84 from which a rib 86 extends. The rib 86 includes opposing end portions 88*a* and 88*b*, which define angularly-extending end faces 90*a* and 90*b*, respectively. The end faces 90*a* and 90*b* extend from the surface 84 angularly towards one another so that the rib 86 is longest at a base 92 thereof which extends along the surface 84. The rib 86 includes a convex surface 94 at its distal end.

The drag 82 includes a raised portion 96 that defines a horizontally-extending surface 98, openings 100*a* and 100*b* on either side of the raised portion 96, and an axially-extending channel 102 formed in the raised portion 96. Notches 104*a* and 104*b* are formed in the raised portion 96 at opposing ends of the channel 102, respectively. The notches 104*a* and 104*b* define angularly-extending surfaces 106*a* and 106*b*, respectively, which extend from the surface 98 and inwardly towards one another to surfaces 108*a* and 108*b*, respectively. Axially-aligned convex surfaces 110*a* and 110*b* are formed on either side of the raised portion 96, and are adjacent the openings 100*a* and 100*b*, respectively. Openings 112*a* and 112*b* are adjacent the convex surfaces 110*a* and 110*b*, respectively. As a result, the convex surface 110*a* extends between the openings 100*a* and 112*a*. Similarly, the convex surface 110*b* extends between the openings 100*b* and 112*b*.

Figure 14:
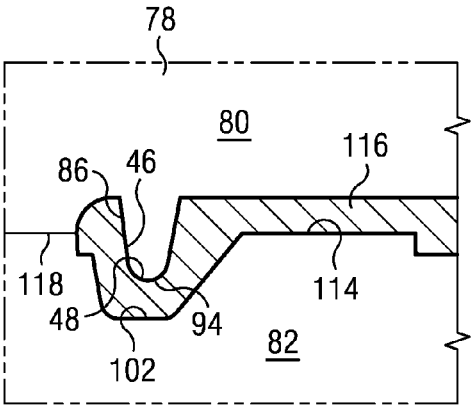
FIG. 14 is a sectional view of the access door of FIGS. 1A-11 during its manufacture using the mold of FIG. 12 according to an exemplary embodiment, the sectional view being taken along line 14-14 of FIG. 12.
Figure 16:
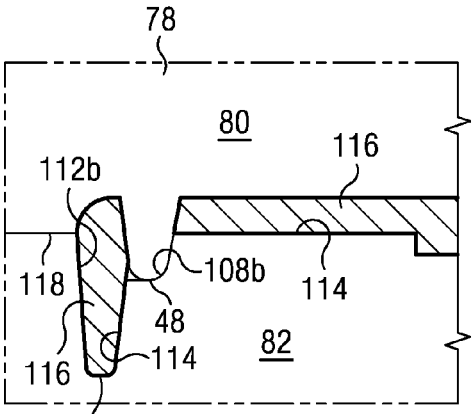
FIG. 16 is yet another sectional view of the access door of FIGS. 1A-11 during its manufacture using the mold of FIG. 12 according to an exemplary embodiment, the sectional view being taken along line 16-16 of FIG. 12.
Figure 15:
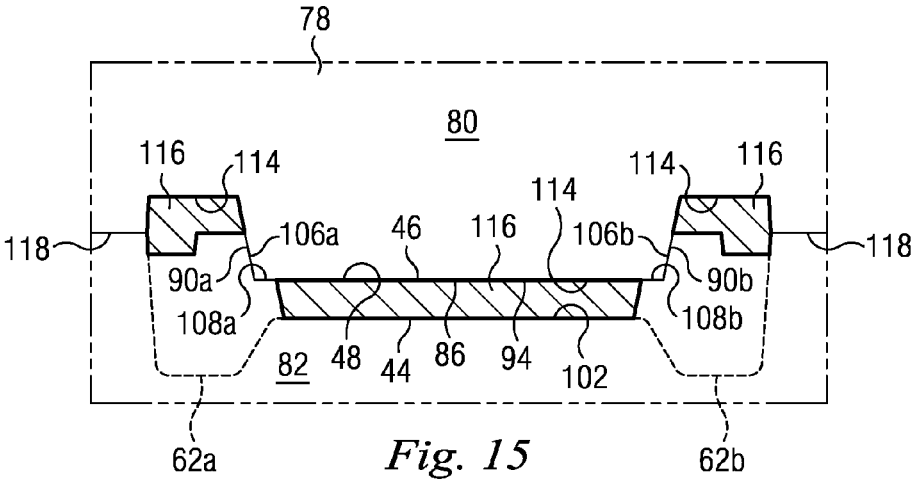
FIG. 15 is another sectional view of the access door of FIGS. 1A-11 during its manufacture using the mold of FIG. 12 according to an exemplary embodiment, the sectional view being taken along line 15-15 of FIG. 12.

In an exemplary embodiment, as illustrated in FIGS. 14-16 with continuing reference to FIGS. 1A-13, to manufacture of the access door 12, the access door 12 is cast using the mold 78 and without a core in the mold 78. More particularly, the cope 80 is engaged with the drag 82 to form the mold 78. The mold 78 defines a cavity 114 therein, portions of which are shown in FIGS. 14-16. The cavity 114 includes at least respective portions of the channel 102 and the openings 100*a*, 100*b*, 112*a* and 112*b*. Before, during and/or after the engagement between the cope 80 and the drag 82, the cavity 114 is filled with a material 116 such as, for example, molten metal. The cope 80 and the drag 82 engage one another, or at least are proximate to each other, generally along a horizontally-extending part line 118.

As shown in FIGS. 14 and 15, before, during and/or after the engagement between the cope 80 and the drag 82 and/or the filling of the cavity 114 with the material 116, the rib 86 extends within the channel 102. A portion of the channel 102 not taken up by the rib 86 forms the ridge 44 of the access door 12. The rib 86 forms the channel 46 of the access door 12, with the convex surface 94 forming the concave surface 48 of the access door 12.

As shown in FIGS. 15 and 16, before, during and/or after the engagement between the cope 80 and the drag 82 and/or the filling of the cavity 114 with the material 116, the opposing end portions 88*a* and 88*b* of the rib 86 extend into the notches 104*a* and 104*b*, respectively. The angularly-extending end face 90*a* of the rib 86 engages the angularly-extending surface 106*a*, and the convex surface 94 of the rib 86 engages the surface 108*a*. As a result, the opening 54*a* of the access door 12 is formed, with the opening 54*a* extending through the plate 42 and the end portion 44*a* in the direction 56 (shown FIG. 11), and also extending from the channel 46 and through the end portion 44*a* of the ridge 44 in the direction 58 (shown in FIGS. 9 and 10), as described above. Similarly, the angularly-extending end face 90*b* of the rib 86 engages the angularly-extending surface 106*b*, and the convex surface 94 of the rib 86 engages the surface 108*b*. As a result, the opening 54*b* of the access door 12 is formed, with the opening 54*b* extending through the plate 42 and the end portion 44*b* in the direction 56, and also extending from the channel 46 and through the end portion 44*b* of the ridge 44 in the direction 60 (shown in FIGS. 9 and 10), as described above. As further shown in FIGS. 15 and 16, before, during and/or after the engagement between the cope 80 and the drag 82 and/or the filling of the cavity 114 with the material 116, the tabs 62*a* and 62*b* of the access door 12 are formed at least in part by the material 116 filing the openings 112*a* and 112*b*, respectively.

Before, during and/or after the engagement between the cope 80 and the drag 82 and/or the filling of the cavity 114 with the material 116, the ears 66*a* and 66*b* of the access door 12 are formed at least in part by the material 116 filling the openings 100*a* and 100*b*, respectively. The notch 70*a* and the concave surface 42*d* of the access door 12 are formed at least in part by the material 116 filling the openings 100*a* and 112*a* and another portion of the cavity 114 that extends across the convex surface 110*a*. Similarly, the notch 70*b* and the concave surface 42*e* of the access door 12 are formed at least in part by the material 116 filling the openings 100*b* and 112*b* and another portion of the cavity 114 that extends across the convex surface 110*b*. The recess 43 of the access door 12 is formed at least in part by the material 116 filling the portion of the cavity 114 that extends across the raised portion 96, with the surface 98 of the drag 82 defining the surface 42*c* of the access door 12.

As a result of the above-described manufacture of the access door 12 by casting the access door 12 using the mold 78, the axially-extending passage 74 of the access door 12 is formed without the use of a core in the mold 78, with the passage 74 being defined by at least the concave surfaces 42*d*, 48 and 42*e*, being generally coaxial with the pivot axis 18, and including the notch 70*a*, the opening 54*a*, the channel 46, the opening 54*b* and the notch 70*b*. Therefore, in response to manufacturing the access door 12 by casting the access door 12 using the mold 78 without a core in the mold 78, the passage 74 is formed such that the pin element 16 may be inserted through the passage 74, without the need for any drilling or machining of the access door 12. The elimination of the need for post-casting drilling or machining of the access door 12 means the access door 12 is much less costly to manufacture. The access door 12 is ready to be hingedly or pivotally coupled to the panel 14, as cast.

Figure 17A:
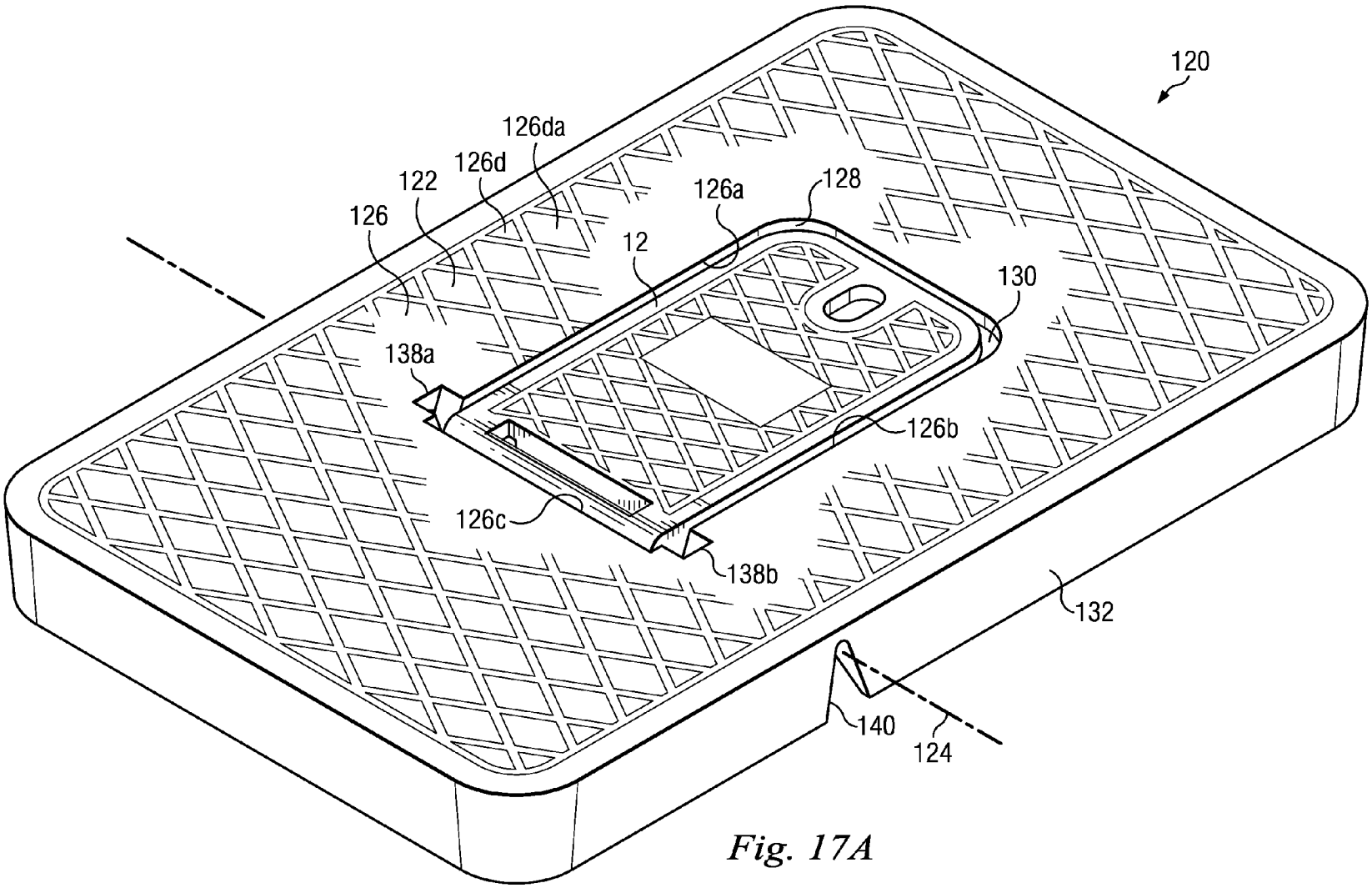
FIG. 17A is a perspective view of an apparatus according to another exemplary embodiment, the apparatus including an access door, a panel such as a meter box cover, and a pin element.
Figure 17B:
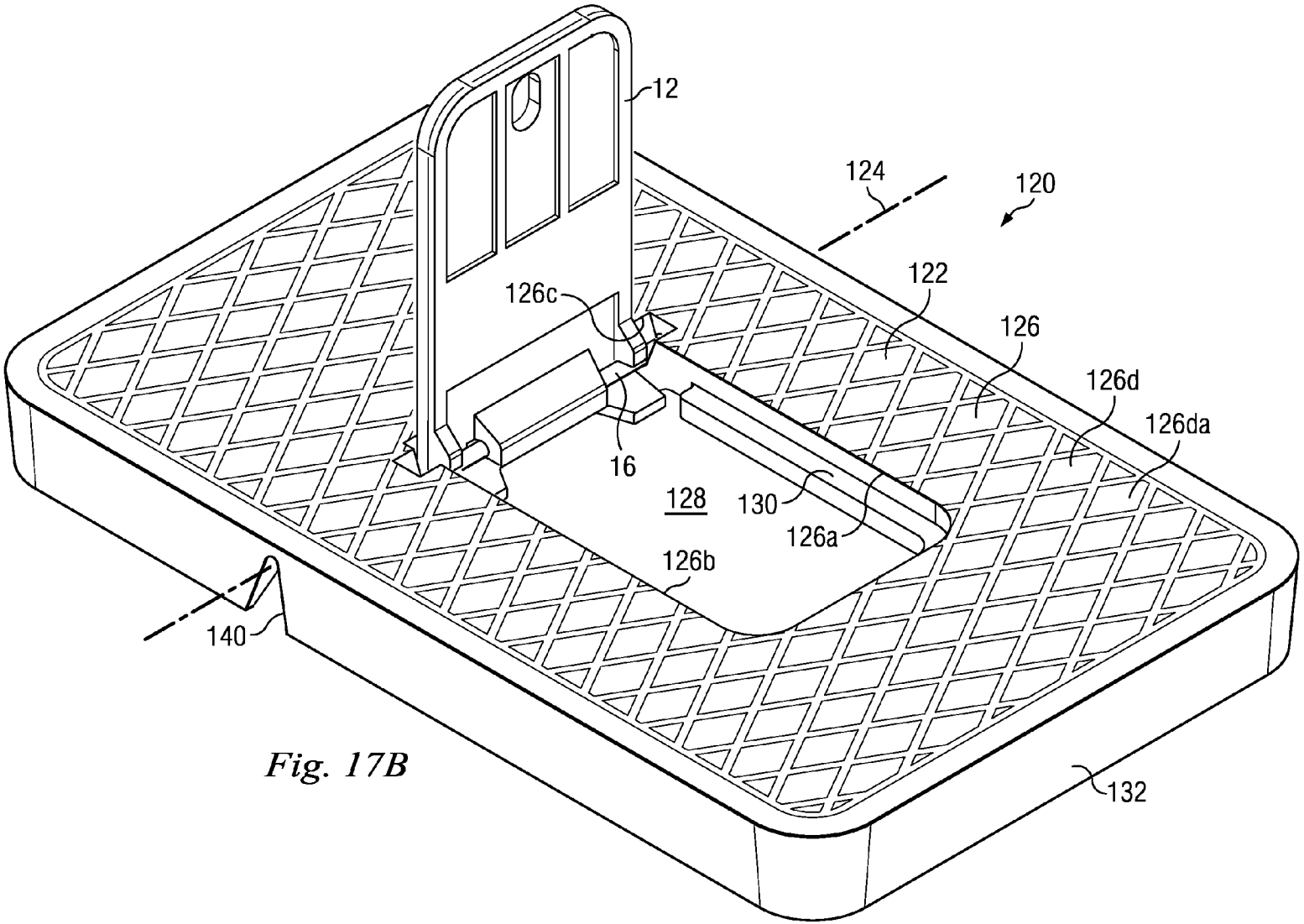
FIG. 17B is another perspective view of the apparatus of FIG. 17A, but depicts the access door in another operational position.

In an exemplary embodiment, as illustrated in FIGS. 17A and 17B, an apparatus is generally referred to by the reference numeral 120 and includes several parts of the apparatus 10, which parts are given the same reference numerals.

As shown in FIGS. 17A and 17B, the apparatus 120 includes the access door 12, which is hingedly or pivotally coupled to a panel 122 via the pin element 16 (shown in FIG. 17B). A pivot axis 124 is defined in part by the access door 12. The pivot axis 124 is generally coaxial with the pivot axis 18 (not shown in FIGS. 17A and 17B) and the pin element 16. Under conditions to be described in detail below, the access door 12 is adapted to pivot, relative to the panel 122, about the pivot axis 124 and between a closed position shown in FIG. 17A and an open position shown in FIG. 17B. In an exemplary embodiment, the panel 122 is a meter box cover such as, for example, a water meter box cover. In an exemplary embodiment, each of the access door 12 and the panel 122 is formed of cast metal, such as ductile iron. In several exemplary embodiments, instead of, or in addition to cast metal, the access door 12 and/or the panel 122 is formed of one or more other materials such as, for example, one or more thermoplastic or thermoset materials.

The panel 122 includes a wall or plate 126 and a generally rectangular opening 128 formed therethrough. The opening 128 defines opposing edges 126*a* and 126*b* of the plate 126. The edges 126*a* and 126*b* are spaced in a parallel relation. The opening 128 further defines an edge 126*c*, which extends between, and is generally perpendicular to, the opposing edges 126*a* and 126*b*. The plate 126 further defines parallel-spaced sides 126*d* and 126*e*, which define horizontally-extending surfaces 126*da* and 126*ea*, respectively (the side 126*e* and the surface 126*ea* are first shown in FIG. 18A). At least a portion of the access door 12 is disposed in the opening 128, regardless of the pivot position of the access door 12 relative to the panel 122. A generally U-shaped internal shoulder 130 is disposed within the opening 128, and faces a direction so that the access door 12 is adapted to engage or nearly engage the shoulder 130 when the access door 12 is in the closed position shown in FIG. 17A. A peripheral flange 132 depends from the plate 126.

Figure 18A:
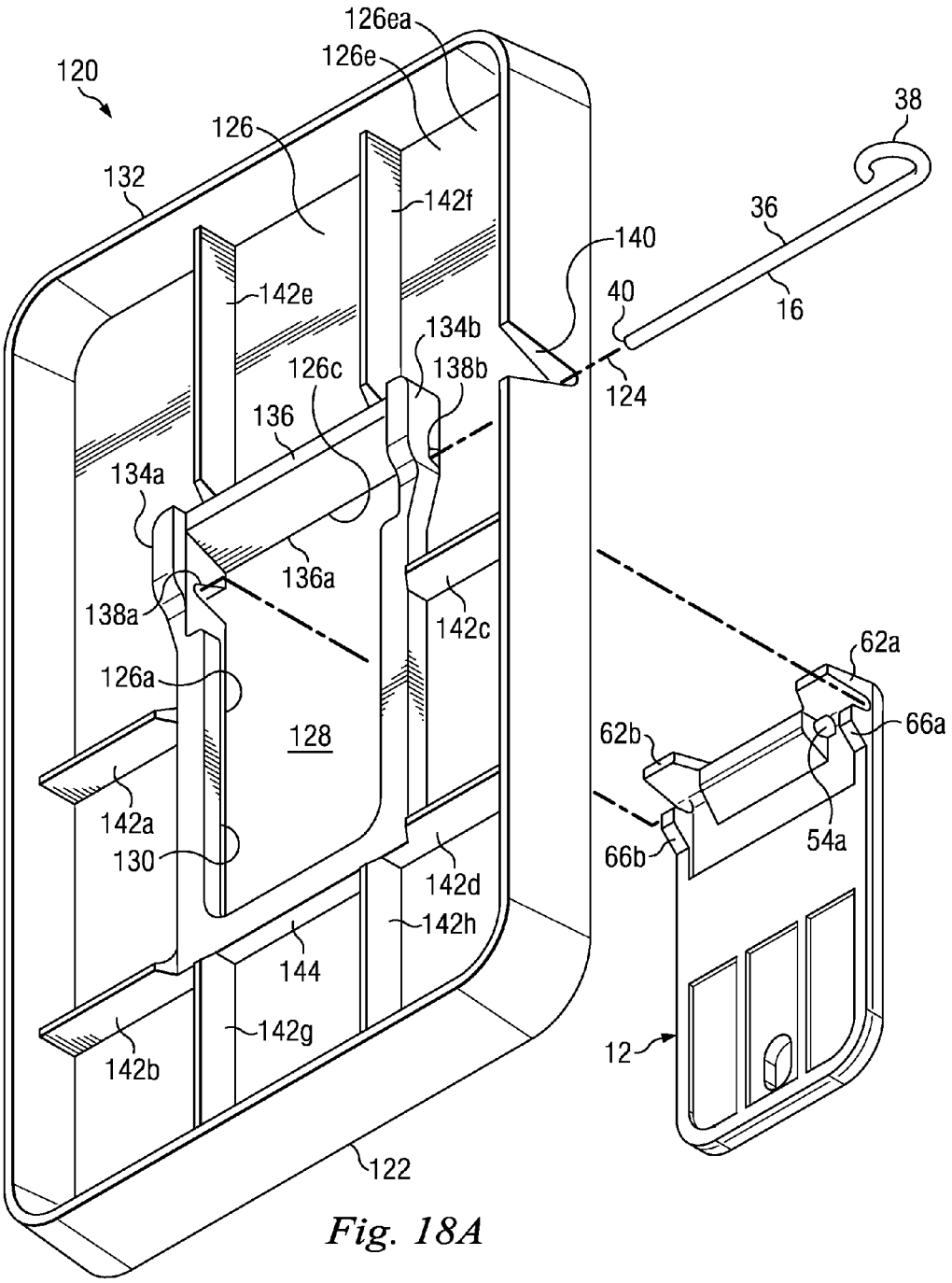
FIG. 18A is an exploded view of the apparatus of FIGS. 17A and 17B.
Figure 18B:
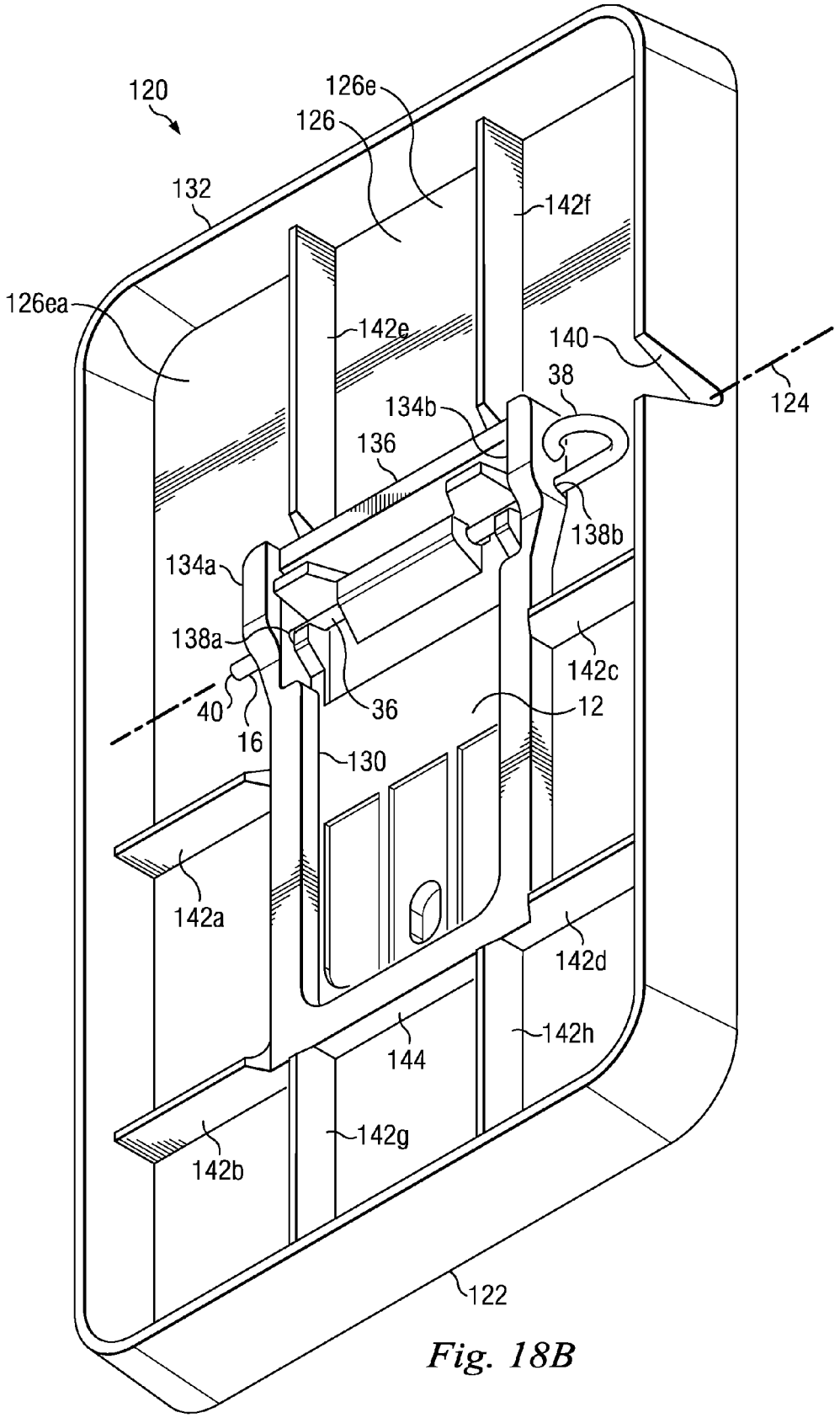
FIG. 18B is a view similar to that of FIG. 18A, but depicts the apparatus of FIGS. 17A and 17B in an unexploded condition.
Figure 19:
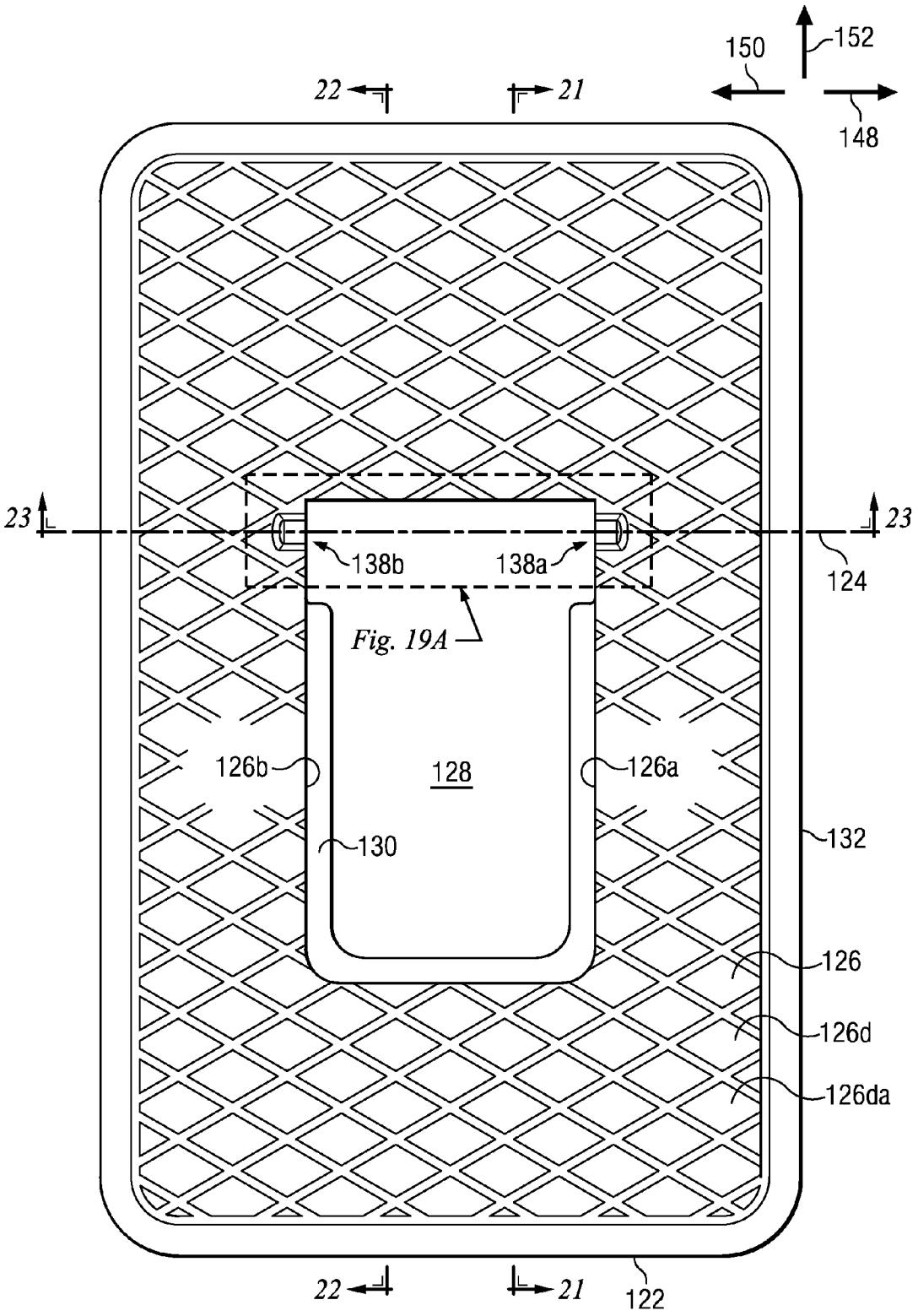
FIG. 19 is a top plan view of the panel of FIGS. 17A, 17B, 18A and 18B, according to an exemplary embodiment.
Figure 19A:
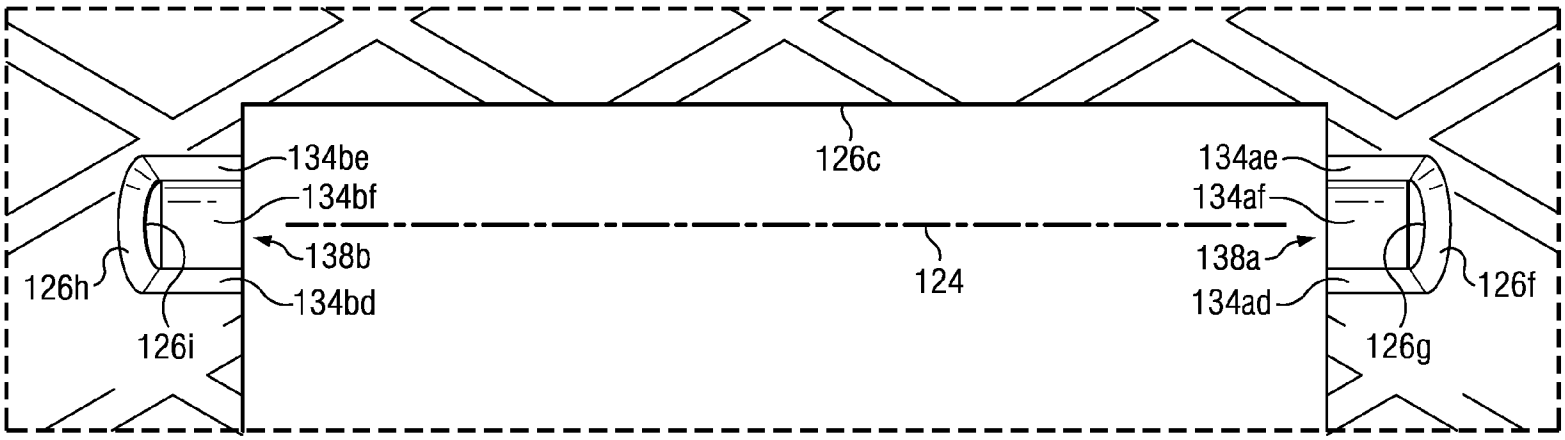
FIG. 19A is an enlarged view of a portion of FIG. 19.
Figure 20:
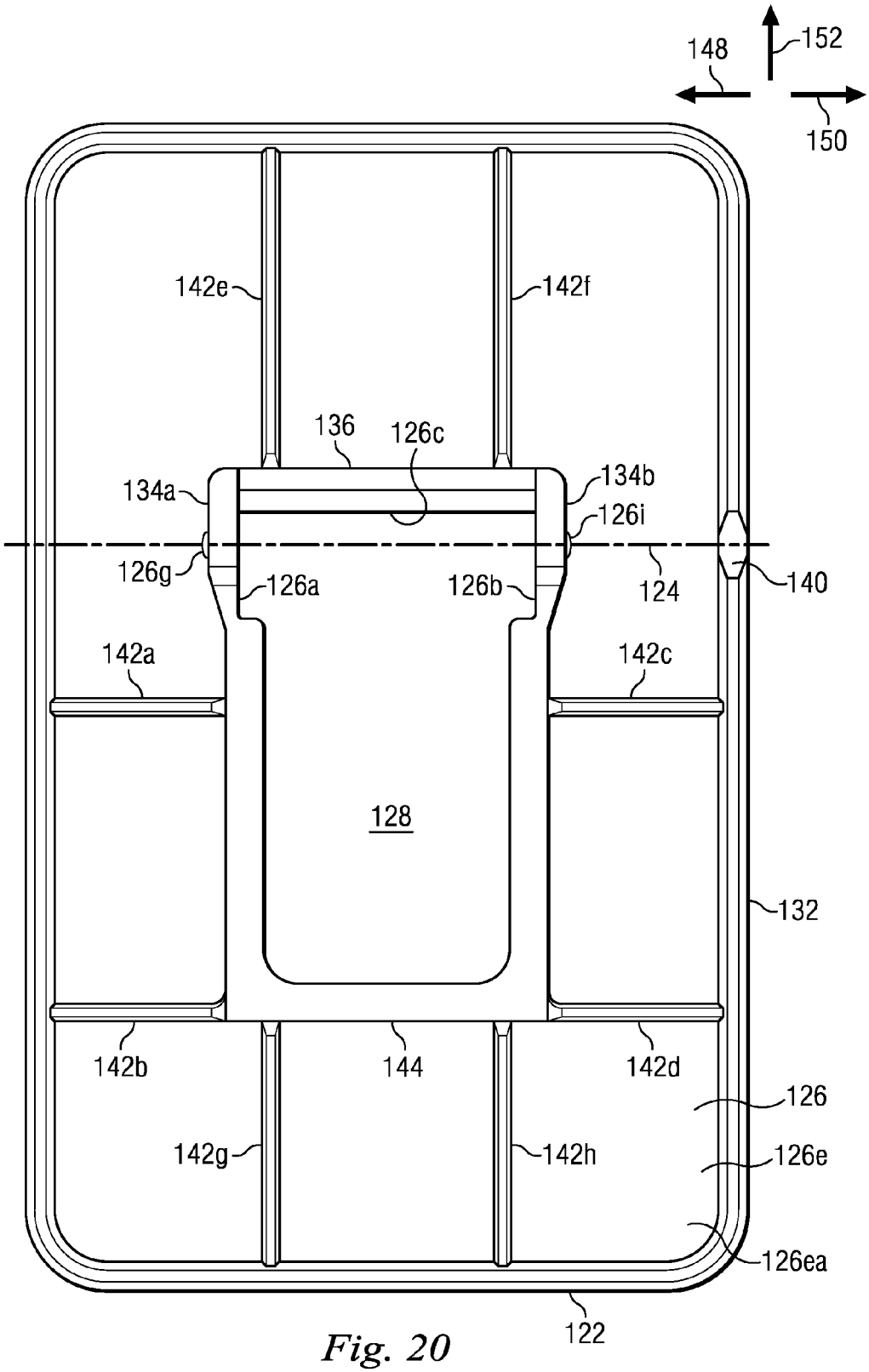
FIG. 20 is a bottom plan view of the panel of FIG. 19.
Figure 21:
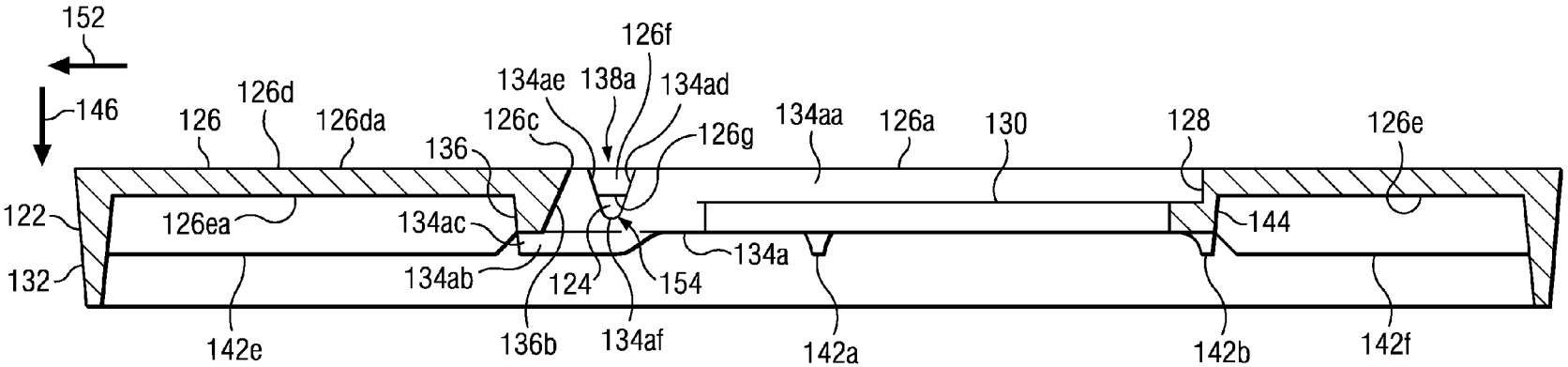
FIG. 21 is a sectional view of the panel of FIG. 19 taken along line 21-21 of FIG. 19.
Figure 22:
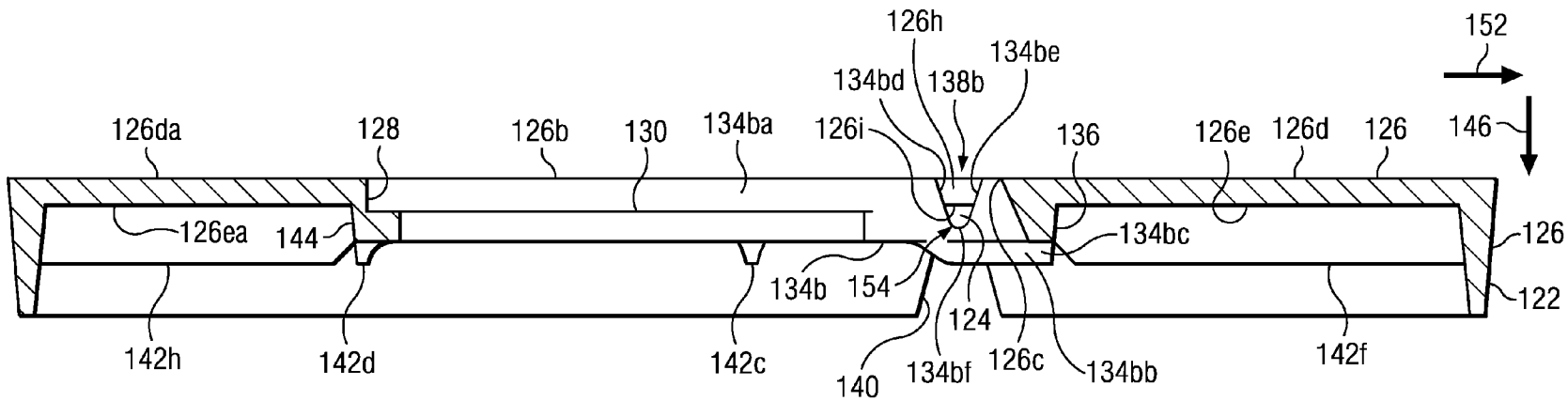
FIG. 22 is a sectional view of the panel of FIG. 19 taken along line 22-22 of FIG. 19.
Figure 23:
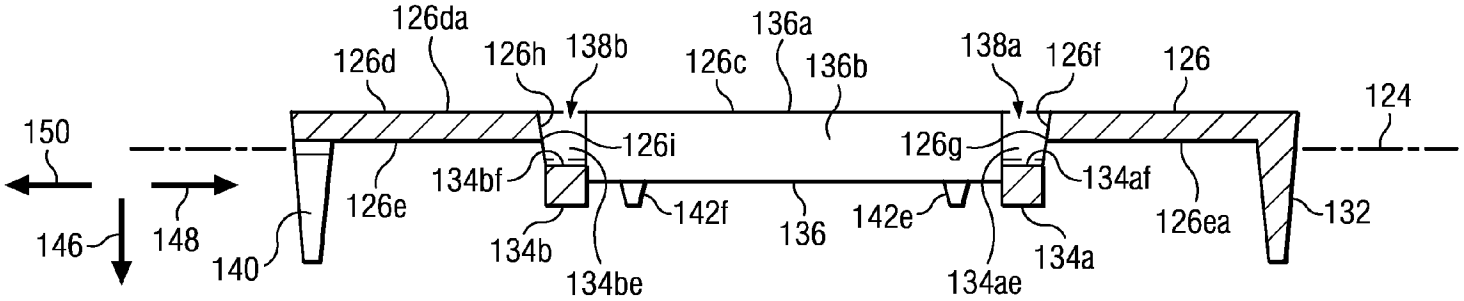
FIG. 23 is a sectional view of the panel of FIG. 19 taken along line 23-23 of FIG. 19.

In an exemplary embodiment, as illustrated in FIGS. 18A and 18B with continuing reference to FIGS. 17A and 17B, the panel 122 further includes opposed walls 134*a* and 134*b*, which are aligned with the opposed edges 126*a* and 126*b*, respectively, of the plate 126. Each of the opposed walls 134*a* and 134*b* extends away from the side 126*d* of the plate 126 in a direction generally opposite the direction which the internal shoulder 130 faces. As a result, the portion of the panel 122 that constitutes the intersection between the plate 126 and the wall 134*a* may be considered to be part of each of the plate 126 and the wall 134*a*. Likewise, the portion of the panel 122 that constitutes the intersection between the plate 126 and the wall 134*b* may be considered to be part of each of the plate 126 and the wall 134*b*. An edge 136*a* of a wall 136 is aligned with the edge 126*c* of the plate 126, and the wall 136 extends between the walls 134*a* and 134*b*. Openings 138*a* and 138*b* extend from the side 126*d*, through the plate 126, and into the opposed walls 134*a* and 134*b*, respectively. The openings 138*a* and 138*b* will be described in further detail below. A notch 140 is formed in the flange 132, and is axially aligned with respective portions of the openings 138*a* and 138*b*. The notch 140 and respective portions of the openings 138*a* and 138*b* are generally coaxial with the pivot axis 124. Ribs 142*a* and 142*b* extend along the plate 126 and between the flange 132 and the wall 134*a*. Ribs 142*c* and 142*d* extend along the plate 126 and between the flange 132 and the wall 134*b*. Ribs 142*e* and 142*f* extend along the plate 126 and between the flange 132 and the wall 136. Ribs 142*g* and 142*h* extend along the plate 126 and between the flange 132 and a wall 144, which opposes the wall 136 and extends between the walls 134*a* and 134*b*.

As shown in FIG. 18B, the rod portion 36 and the non-hooked end portion 40 of the pin element 16, and the openings 138*a* and 138*b*, are each sized so that the rod portion 36 is permitted to extend through the openings 138*a* and 138*b*, under conditions to be described below. The notch 140 is sized to permit the pin element 16, including the hooked end portion 38, to pass through the notch 140, under conditions to be described below.

In an exemplary embodiment, as illustrated in FIGS. 19-23 with continuing reference to FIGS. 17A-18B, the wall 134*a* defines a vertically-extending surface 134*aa*, which is aligned with, and extends along, the edge 126*a* of the plate 126. As noted above, the wall 134*a* extends away from the plate 126 in a direction generally opposite the direction which the internal shoulder 130 faces. Thus, the wall 134*a* extends away from the plate 126 in a direction 146 (shown in FIGS. 21-23), which is generally perpendicular to the pivot axis 124. A recess 134*ab* is formed in the surface 134*aa*, and defines a vertically-extending surface 134*ac*. The wall 134*b* defines a vertically-extending surface 134*ba*, which is aligned with, and extends along, the edge 126*a* of the plate 126. As noted above, the wall 134*b* extends away from the plate 126 in a direction generally opposite the direction which the internal shoulder 130 faces. Thus, the wall 134*b* extends away from the plate 126 in the direction 146, which is generally perpendicular to the pivot axis 124. A recess 134*bb* is formed in the surface 134*ba*, and defines a vertically-extending surface 134*bc*. The wall 136 defines an angularly-extending surface 136*b*, which is aligned with, and extends along, the edge 126*c* of the plate 126. The angularly-extending surface 136*b* extends between the vertically-extending surfaces 134*aa* and 134*ba* of the walls 134*a* and 134*b*, respectively.

In an exemplary embodiment, as illustrated in FIGS. 19-25 with continuing reference to FIGS. 17A-18B, and as noted above, the opening 138*a* extends from the side 126*d* of the plate 126, through the plate 126, and into the wall 134*a*. More particularly, the opening 138*a* extends through the plate 126 in the direction 146. Further, the opening 138*a* extends through the wall 134*a* from the opening 128 in a direction 148, which is generally parallel to the pivot axis 124. As noted above, the opening 138*b* extends from the side 126*d* of the plate 126, through the plate 126, and into the wall 134*b*. More particularly, the opening 138*b* extends through the plate 126 in the direction 146. Further, the opening 138*b* extends through the wall 134*b* from the opening 128 in a direction 150, which is generally parallel to the pivot axis 124 and generally opposite to the direction 148.

Surfaces 134*ad* and 134*ae* of the wall 134*a* are defined by the opening 138*a*, and extend angularly inward and towards each other. The angularly-extending surface 134*ae* is spaced from the angularly-extending surface 134*ad* in a direction 152 (shown in FIGS. 21 and 22), which is generally perpendicular to each of the pivot axis 124 and the directions 146, 148 and 150. A concave surface 134*af* of the wall 134*a* is also defined by the opening 138*a*. At least a portion of the concave surface 134*af* extends between the distal ends of the surfaces 134*ad* and 134*ae*. In an exemplary embodiment, the concave surface 134*af* extends between, and joins, the distal ends of the surfaces 134*ad* and 134*ae* so that the surfaces 134*ad*, 134*af* and 134*ae* are generally continuous. At least a portion of the concave surface 134*af* is spaced from the surface 126*ea* and thus the side 126*e* of the plate 126 in the direction 146.

Surfaces 134*bd* and 134*be* of the wall 134*b* are defined by the opening 138*b*, and extend angularly inward and towards each other. The angularly-extending surface 134*be* is spaced from the angularly-extending surface 134*bd* in the direction 152. A concave surface 134*bf* of the wall 134*b* is also defined by the opening 138*a*. At least a portion of the concave surface 134*bf* extends between the distal ends of the surfaces 134*bd* and 134*be*. In an exemplary embodiment, the concave surface 134*bf* extends between, and joins, the distal ends of the surfaces 134*bd* and 134*be* so that the surfaces 134*bd*, 134*bf* and 134*be* are generally continuous. At least a portion of the concave surface 134*bf* is spaced from the surface 126*ea* and thus the side 126*e* of the plate 126 in the direction 146. The concave surface 134*bf* is also axially spaced from the concave surface 134*af* in the direction 150.

A surface 126*f* of the plate 126 is defined by the opening 138*a*. The surface 126*f* extends from the angularly-extending edge of the surface 134*ad* in a direction away from the opening 128, and curves back to the angularly-extending edge of the surface 134*ae*. An edge 126*g* of the surface 126*f* is also defined by the opening 138*a*, and thus also extends from the surface 134*ad* and curves back to the surface 134*ae*. A surface 126*h* of the plate 126 is defined by the opening 138*b*. The surface 126*h* extends from the angularly-extending edge of the surface 134*bd* in a direction away from the opening 128, and curves back to the angularly-extending edge of the surface 134*be*. An edge 126*i* of the surface 126*h* is also defined by the opening 138*b*, and thus also extends from the surface 134*bd* and curves back to the surface 134*be*. The concave surface 134*af* is axially spaced from the respective portions of the surface 126*ea* that are adjacent the edges 126*g* and 126*i* of the plate 126 and that are generally axially aligned along the pivot axis 124. The concave surface 134*bf* is also axially spaced from the respective portions of the surface 126*ea* that are adjacent the edges 126*g* and 126*i* of the plate 126 and that are generally axially aligned along the pivot axis 124.

An axially-extending passage 154 is defined by at least the surface 126*ea*, the concave surfaces 134*af* and 134*bf*, the surfaces 134*ad* and 134*ae*, and the surfaces 134*bd* and 134*be*. The passage 154 is generally coaxial with the pivot axis 124. The passage 154 includes the notch 140 and the openings 138*a* and 138*b*.

In an exemplary embodiment, the panel 122 is integrally formed and thus the plate 126, the internal shoulder 130, the flange 132, the walls 134*a* and 134*b*, and the ribs 142*a-h*, are integrally formed. In an exemplary embodiment, the panel 122 is a casting and thus is integrally formed of cast metal, such as ductile iron. In several exemplary embodiments, instead of, or in addition to cast metal, the panel 122 is integrally formed of one or more other materials such as, for example, one or more thermoplastic or thermoset materials.

In an exemplary embodiment, with continuing reference to FIGS. 17A-25, to place the apparatus 120 in its assembled condition as shown in FIGS. 17A, 17B and 18B, the access door 12 is positioned, relative to the panel 122, so that: each of the tabs 62*a* and 62*b* of the access door 12 is adjacent the edge 136*a* of the wall 136, the ears 66*a* and 66*b* of the access door 12 are adjacent the walls 134*b* and 134*a*, respectively, and the axially-extending passage 74 of the access door 12 is generally coaxial with the axially-extending passage 154 of the panel 122. The pin element 16 is passed through the notch 140 so that the non-hooked end portion 40 is inserted through the opening 138*b* of the panel 122, the passage 74 of the access door 12, and the opening 138*a* of the panel 122. Thus, the non-hooked end portion 40 is inserted through the passage 154 of the panel 122. The hooked end portion 38 of the pin element 16 prevents the pin element 16 from passing completely though the opening 138*b* of the panel 122. As a result, the rod portion 36 of the pin element 36 extends through the opening 138*b* of the panel 122, the passage 74 of the access door 12, and the opening 138*a* of the panel 122. Thus, the rod portion 36 of the pin element 16 extends through the passage 154 of the panel 122, thereby hingedly or pivotally coupling the access door 12 to the panel 122. The rod portion 36 of the pin element 16, the passage 74 of the access door 12, the openings 138*a* and 138*b* of the panel 122, and the passage 154 of the panel 122, are all generally coaxial with the pivot axis 124.

In operation, in an exemplary embodiment, with continuing reference to FIGS. 17A-25, after the apparatus 120 has been placed in its assembled condition as described above, the access door 12 pivots, relative to the panel 122, about the pivot axis 124. The access door 12 pivots between the closed position shown in FIG. 17A and the open position shown in FIG. 17B. When the access door 12 is in the closed position shown in FIG. 17A, the side 42*b* of the plate 42 of the access door 12 engages or nearly engages the shoulder 130, and/or the tabs 62*a* and 62*b* of the access door 12 engage or nearly engage the wall 136, thereby resisting any further pivoting of the access door 12 in a clockwise direction, as viewed in FIGS. 17A and 17B, after the access door 12 has been placed in the closed position shown in FIG. 17A. When the access door 12 is in the open position shown in FIG. 17B, the side 42*a* of the plate 42 of the access door 12 engages or nearly engages the panel 122 at the edge 126*c*, which is aligned with the edge 136*a* of the wall 136, thereby resisting any further pivoting of the access door 12 in a counterclockwise direction, as viewed in FIGS. 17A and 17B.

During the pivoting of the access door 12 relative to the panel 122, the respective shapes of the concave surfaces 134*af* and 134*bf* of the panel 122 minimize any resistance to the pivoting of the access door 12 about the rod portion 36 of the pin element 16, thereby facilitating the pivoting of the access door 12. Further, the positioning of the respective centers of curvature of the concave surfaces 134*af* and 134*bf* along the pivot axis 124 minimizes any resistance to the pivoting of the access door 12 about the rod portion 36 of the pin element 16, thereby facilitating the pivoting of the access door 12.

In several exemplary embodiments, before, during and/or after the above-described exemplary operation of the apparatus 120, the extension of the pin element 16 through the opening 138*b* of the panel 122, the passage 74 of the access door 12, and the opening 138*a* of the panel 122, and thus through the passage 154 of the panel 122, maintains the pivotal coupling between the access door 12 and the panel 122. For example, the extension of the pin element 16 between the surfaces 134*bd* and 134*be*, and between the surfaces 134*ad* and 134*ae*, resists any movement of the access door 12, relative to the pin element 16 and thus the panel 122, in the direction 152 or a direction opposite thereof, regardless of the pivot position of the access door 12. For another example, the extension of the pin element 16 between the side 126*e* of the plate 126 and the concave surfaces 134*af* and 134*bf* resists any movement of the access door 12, relative to the pin element 16 and thus the panel 122, in either the direction 146 or a direction opposite thereof, regardless of the pivot position of the access door 12.

Figure 28:
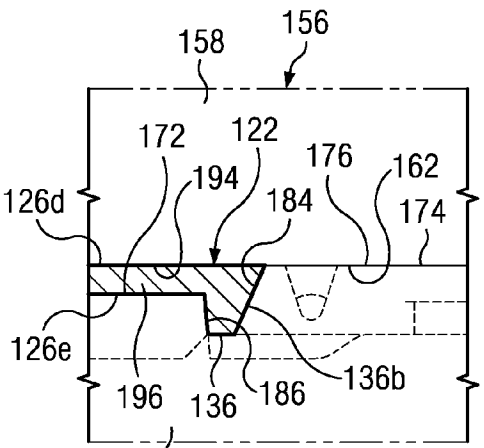
FIG. 28 is another sectional view of the panel of FIGS. 17A-25 during its manufacture using the mold of FIG. 26 according to an exemplary embodiment, the sectional view being taken along line 28-28 of FIG. 26.
Figure 27:
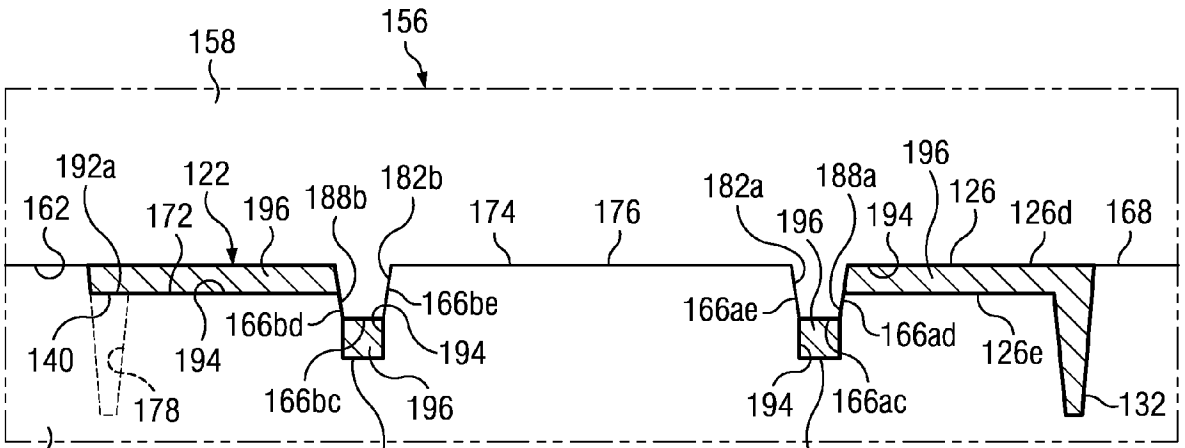
FIG. 27 is a sectional view of the panel of FIGS. 17A-25 during its manufacture using the mold of FIG. 26 according to an exemplary embodiment, the sectional view being taken along line 27-27 of FIG. 26.
Figure 24:
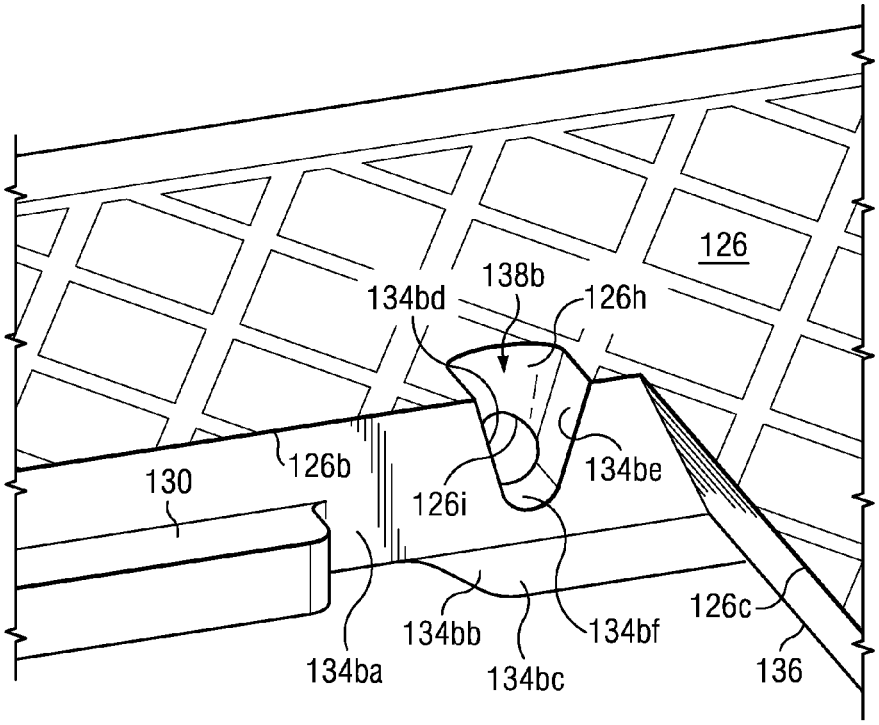
FIG. 24 is a perspective view of a portion of the panel of FIG. 19.
Figure 25:
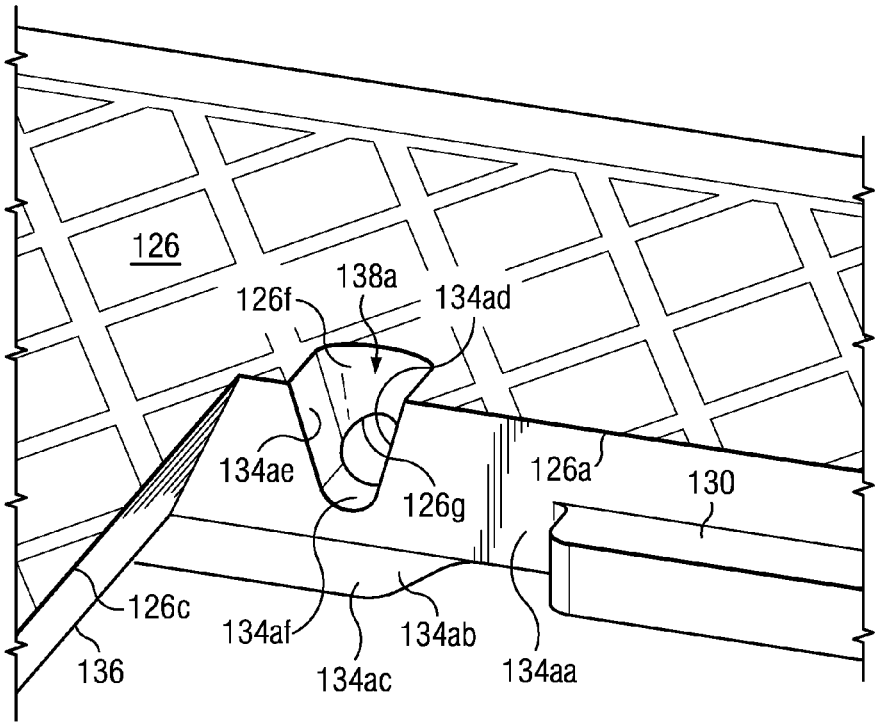
FIG. 25 is a perspective view of another portion of the panel of FIG. 19.
Figure 26:
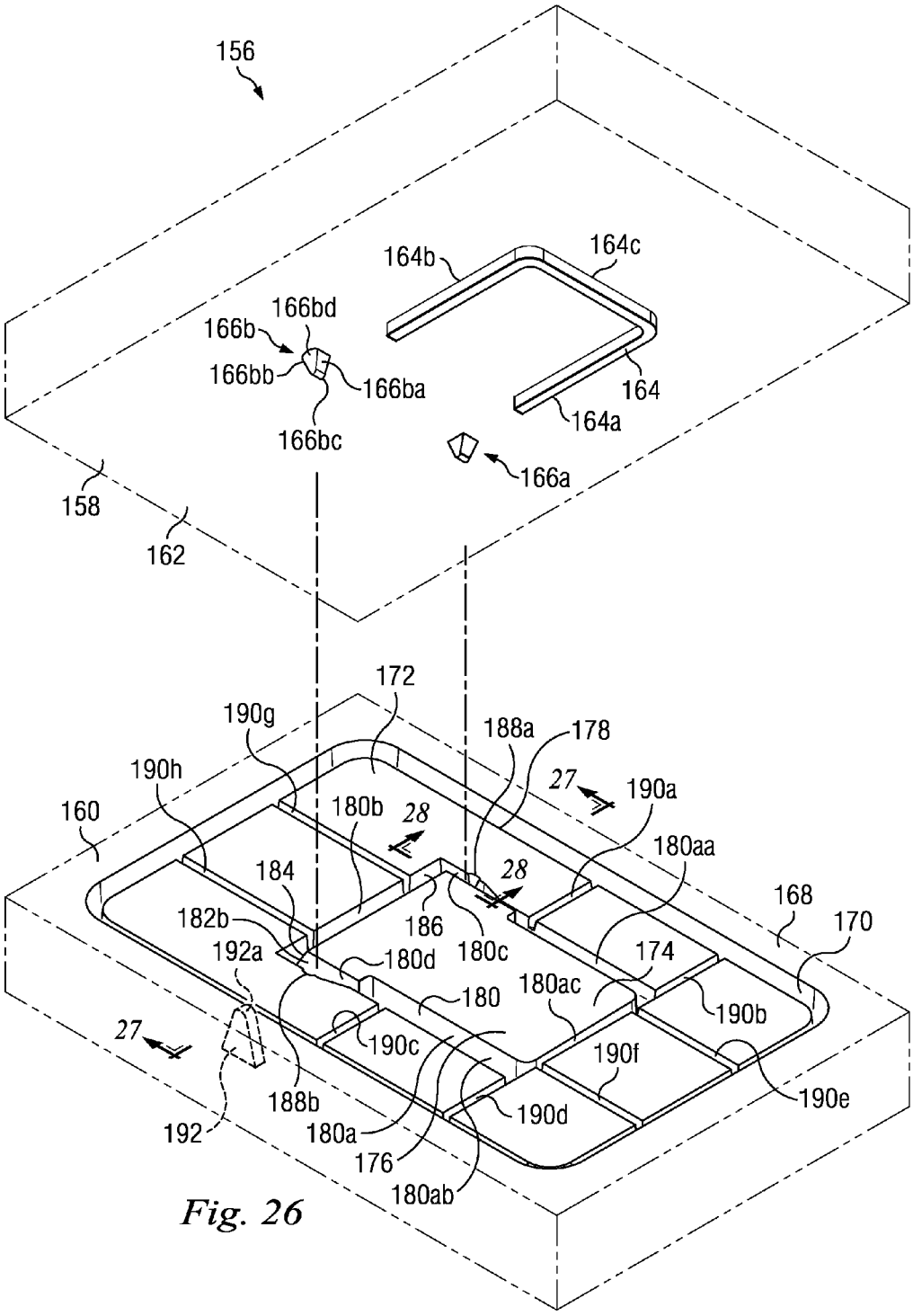
FIG. 26 is a perspective view of a horizontally-parted mold that is used to manufacture the panel of FIGS. 17A-25, the mold including upper and lower halves, according to an exemplary embodiment.

In an exemplary embodiment, as illustrated in FIGS. 26, 27 and 28 with continuing reference to FIGS. 17A-25, a horizontally-parted mold is generally referred to by the reference numeral 156 and includes an upper part, such as an upper half or cope 158, and a lower part, such as a lower half or drag 160. The mold 156 is used to manufacture the panel 122 of FIGS. 17A-25. The mold 156 does not include any cores such as, for example, hinge tubes or other cores, therein. In several exemplary embodiments, in addition to the cope 158 and the drag 160, the mold 156 includes, and/or employs, one or more gates, runner systems, etc., but does not include any cores, such as hinge tubes or other cores, therein. The broken line illustrations in FIG. 26 indicate that the mold 156 includes additional structure other than the cope 158 and the drag 160.

The cope 158 includes a horizontally-extending surface 162 from which a U-shaped projection 164 extends. The U-shaped projection 164 includes parallel-spaced portions 164*a* and 164*b*, and a transversely-extending portion 164*c*.

Spaced protrusions 166*a* and 166*b* extend from the surface 162. The protrusions 166*a* and 166*b* are aligned along a direction that is generally perpendicular to the parallel-spaced portions 164*a* and 164*b*. The spacing between the protrusions 166*a* and 166*b* is greater than the spacing between the parallel-spaced portions 164*a* and 164*b*. The protrusion 166*b* defines angularly-extending surfaces 166*ba* and 166*bb*, which extend angularly upward and towards each other from the surface 162. A convex curved surface 166*bc* joins the respective edges of the surfaces 166*ba* and 166*bb* that are opposite the surface 162. As a result, the surfaces 166*ba*, 166*bb* and 166*bc* are generally continuous. A convex curved surface 166*bd* joins the respective edges of the surfaces 166*ba*, 166*bb* and 166*bc* that are opposite the portion 164*b*. The convex surface 166*bd* extends angularly upward from the surface 162. An angularly-extending surface 166*be* (shown in FIG. 27) extends upward from the surface 162 to the surface 166*bc*, and between the surfaces 166*ba* and 166*bb*.

The protrusion 166*a* is symmetrically equivalent to the protrusion 166*b* about an axis that is disposed generally midway between, and is generally parallel to, the parallel-spaced portions 164*a* and 164*b*. Since the protrusion 166*a* is symmetrically equivalent to the protrusion 166*b*, the protrusion 166*a* will not be described in further detail. Reference numerals used to refer to the features of the protrusion 166*a* that are identical to the features of the protrusion 166*b* will correspond to the reference numerals used to refer to the features of the protrusion 166*b*, except that the prefix for the reference numerals used to refer to the features of the protrusion 166*b*, that is, 166*b*, will be replaced by the prefix of the protrusion 166*a*, that is, 166*a*.

The drag 160 defines a horizontally-extending outer surface 168 in which a generally rectangular recess 170 is formed. A horizontally-extending recessed surface 172 is defined by the rectangular recess 170. The horizontally-extending surfaces 168 and 172 are vertically offset from each other. As viewed in FIGS. 26 and 27, the surface 172 is vertically lower than the surface 168. A raised inner portion 174 of the drag 160 is defined by the rectangular recess 170. A horizontally-extending inner surface 176 is defined by the raised portion 174. The horizontally-extending inner surface 176 is generally coplanar with the horizontally-extending outer surface 168. Thus, as viewed in FIGS. 26-28, the surface 176 is vertically higher than the surface 172.

A generally rectangular outer channel 178 and a generally rectangular inner channel 180 are formed in the horizontally-extending surface 172. The inner channel 180 is formed around the raised portion 174. The inner channel 180 includes a U-shaped portion 180*a* having parallel-spaced portions 180*aa* and 180*ab*, and a transversely-extending portion 180*ac*. The inner channel 180 further includes another transversely-extending portion 180*b*, which is spaced in a generally parallel relation from the transversely-extending portion

180*ac* of the U-shaped portion 180*a*. The channel 180 further includes parallel-spaced portions 180*c* and 180*d*, which extend between the transversely-extending portion 180*b* and respective ends of the parallel-spaced portions 180*aa* and 180*ab* of the U-shaped portion 180*a*.

Angularly-extending surfaces 182*a* and 182*b* are defined by the portions 180*c* and 180*d*, respectively, of the inner channel 180 (the surface 182*a* is shown in FIG. 27). The surfaces 182*a* and 182*b* are symmetrically equivalent about an axis that is disposed generally midway between, and is generally parallel to, the parallel-spaced portions 180*aa* and 180*ab* of the U-shaped portion 180*a* of the inner channel 180. Each of the surfaces 182*a* and 182*b* extends angularly downward and away from the horizontally-extending inner surface 176 defined by the raised inner portion 174. Surfaces 184 and 186 are defined by the transversely-extending portion 180*b* of the inner channel 180.

A notch 188*a* is formed in a surface that is defined by the portion 180*c* of the inner channel 180 and that opposes the angularly-extending surface 182*a*. The notch 188*a* defines surfaces that are shaped to receive and mate with the surfaces 166*aa*, 166*ab*, 166*ac* and 166*ad*, respectively, of the protrusion 166*a* of the cope 158. Similarly, a notch 188*b* is formed in a surface that is defined by the portion 180*d* of the inner channel 180 and that opposes the angularly-extending surface 182*b*. The notch 188*b* defines surfaces that are shaped to receive and mate with the surfaces 166*ba*, 166*bb*, 166*bc* and 166*bd*, respectively, of the protrusion 166*b* of the cope 158. The notches 188*a* and 188*b* are aligned along a direction that is generally perpendicular to the portions 180*aa* and 180*ab* of the U-shaped portion 180*a* of the inner channel 180, and to the portions 180*c* and 180*d* of the inner channel 180.

Channels 190*a* and 190*b* are formed in the surface 172 and extend between the outer channel 178 and the portion 180*aa* of the U-shaped portion 180*a* of the inner channel 180. Channels 190*c* and 190*d* are formed in the surface 172 and extend between the outer channel 178 and the portion 180*ab* of the U-shaped portion 180*a* of the inner channel 180. Channels 190*e* and 190*f* are formed in the surface 172 and extend between the outer channel 178 and the portion 180*ac* of the U-shaped portion 180*a* of the inner channel 180. Channels 190*g* and 190*h* are formed in the surface 172 and extend between the outer channel 178 and the transversely-extending portion 180*b* of the inner channel 180.

A protrusion 192 extends upward within the outer channel 178. The protrusion 192 is aligned with the notches 188*a* and 188*b* along a direction that is generally perpendicular to the portions 180*aa* and 180*ab* of the U-shaped portion 180*a* of the inner channel 180, and to the portions 180*c* and 180*d* of the inner channel 180. The protrusion 192 is positioned in the outer channel 178 so that the notch 188*b* is positioned between the notch 188*a* and the protrusion 192. The protrusion 192 defines a convex curved surface 192*a* that is vertically offset from the surface 168. As viewed in FIGS. 26 and 27, the convex curved surface 192*a* is vertically lower than the surface 168.

In an exemplary embodiment, as illustrated in FIGS. 26, 27 and 28 with continuing reference to FIGS. 17A-25, to manufacture the panel 122, the panel 122 is cast using the mold 156 without a core in the mold 156. More particularly, the cope 158 is engaged with the drag 160 to form the mold 156. The mold 156 defines a cavity 194, portions of which are shown in FIGS. 27 and 28. Before, during and/or after the engagement between the cope 158 and the drag 160, the cavity 194 is filled with a material 196 such as, for example, molten metal. The cope 158 and the drag 160 engage each other, or at least are proximate to each other, along a horizontally-extending part line generally corresponding to the interface between the surface 162 of the cope 158 and the surfaces 168 and 176 of the drag 160.

Before, during and/or after the engagement between the cope 158 and the drag 160 and/or the filling of the cavity 194 with the material 196, the surface 162 engages the surface 176. As a result, the opening 128 of the panel 122 is at least partially formed. The U-shaped projection 164 extends within the U-shaped portion 180*a* of the inner channel 180, thereby at least partially forming the internal shoulder 130 of the panel 122.

As shown in FIGS. 27 and 28, before, during and/or after the engagement between the cope 158 and the drag 160 and/or the filling of the cavity 194 with the material 196, the protrusion 166*a* extends within the notch 188*a*, the surfaces of which receive and mate with the surfaces 166*aa*, 166*ab*, 166*ac* and 166*ad* of the protrusion 166*a*. As a result, the opening 138*a* of the panel 122 is formed, with the opening 138*a* extending through the plate 126 in the direction 146, and also extending through the wall 134*a* from the opening 128 in the direction 148. Likewise, the protrusion 166*b* extends within the notch 188*b*, the surfaces of which receive and mate with the surfaces 166*ba*, 166*bb*, 166*bc* and 166*bd* of the protrusion 166*b*. As a result, the opening 138*b* of the panel 122 is formed, with the opening 138*b* extending through the plate 126 in the direction 146, and also extending through the wall 134*b* from the opening 128 in the direction 150. The openings 138*a* and 138*b* are formed and are generally coaxial with the pivot axis 124 as cast. The protrusion 192 at least partially forms the notch 140 of the panel 122. The filling of the material 196 in the respective portions of the cavity 194 corresponding to the channels 190*a*, 190*b*, 190*c*, 190*d*, 190*e*, 190*f*, 190*g* and 190*h* at least partially forms the ribs 142*a*, 142*b*, 142*c*, 142*d*, 142*g*, 142*h*, 142*e* and 142*f*, respectively, of the panel 122. The filling of the material 196 in the portion of the cavity 194 extending between the surfaces 162 and 172 at least partially forms the plate 126 of the panel 122. The filling of the material 196 in the portion of the cavity 194 corresponding to the portions 180*aa* and 180*c* of the inner channel 180 at least partially forms the wall 134*a* of the panel 122. The filling of the material 196 in the portion of the cavity 194 corresponding to the portions 180*ab* and 180*d* at least partially forms the wall 134*b* of the panel 122. The filling of the material 196 in the portion of the cavity 194 corresponding to the transversely-extending portion 180*b* of the inner channel 180 at least partially forms the wall 136 of the panel 122. The filling of the material 196 in the portion of the cavity 194 corresponding to the portion 180*ac* of the U-shaped portion 180*a* of the inner channel 180 at least partially forms the wall 144 of the panel 122 (the wall 144 is not shown in FIGS. 27 and 28).

As a result of the above-described manufacture of the panel 122 by casting the panel 122 using the mold 156, the openings 128, 138*a* and 138*b* of the panel 122 are formed without a core in the mold 156. Therefore, in response to manufacturing the panel 122 by casting the panel 122 using the mold 156 without a core in the mold 156, the end portion 40 of the pin element 16 may be inserted along the pivot axis 124 and through the notch 140, the opening 138*b* and the opening 138*a*, as indicated in FIGS. 18A and 18B, without the need for any drilling or machining of the panel 122. The elimination of the need for post-casting drilling or machining of the panel 122 means the panel 122 is much less costly to manufacture. The panel 122 is ready to be hingedly or pivotally coupled to the access door 12, as cast.

An access door adapted to be pivotally coupled to a panel such as a meter box cover has been described, the access door at least partially defining a pivot axis about which the access door is adapted to pivot relative to the panel, the access door including a plate defining first and second sides; a ridge extending along the first side of the plate, the ridge including opposing first and second end portions; a channel formed in the second side of the plate, and extending into the ridge and axially therealong; a first opening extending through the plate and the first end portion of the ridge in a first direction that is generally perpendicular to the pivot axis, and also extending from the channel and through the first end portion of the ridge in a second direction that is generally parallel to the pivot axis; a second opening extending through the plate and the second end portion of the ridge in the first direction, and also extending from the channel and through the second end portion of the ridge in a third direction that is generally parallel to the pivot axis and opposite to the second direction; and an axially-extending passage including the channel, the first opening, and the second opening, wherein the passage is generally coaxial with the pivot axis and a pin element is adapted to extend through the passage to thereby pivotally couple the access door to the panel. In an exemplary embodiment, the access door includes first and second notches formed in the first side of the plate; wherein the first opening, the channel, and the second opening are axially positioned between the first and second notches; and wherein the passage further includes the first and second notches. In an exemplary embodiment, the first and second notches define axially-aligned first and second concave surfaces, respectively; wherein the channel defines a third concave surface, the third concave surface being axially positioned between the first and second concave surfaces; and wherein each of the first and second concave surfaces is spaced from the third concave surface, in a fourth direction that is perpendicular to the pivot axis and opposite to the first direction, so that the respective centers of curvature of the first, second and third concave surfaces lie generally along the pivot axis. In an exemplary embodiment, when the pin element extends through the passage to thereby pivotally couple the access door to the panel: the pin element is generally coaxial with each of the passage and the pivot axis; and the pin element extends through the first notch, the first opening, the channel, the second opening, and the second notch. In an exemplary embodiment, the access door includes first and second ears, each of which defines a first angularly-extending surface; first and second tabs, each of which defines a second angularly-extending surface; wherein the first concave surface defined by the first notch joins respective ends of the first angularly-extending surface of the first ear and the second angularly-extending surface of the first tab; wherein the second concave surface defined by the second notch joins respective ends of the first angularly-extending surface of the second ear and the second angularly-extending surface of the second tab; wherein the first angularly-extending surface of the first ear is spaced from the second angularly-extending surface of the first tab in a fifth direction that is generally perpendicular to each of the pivot axis and the first, second, third and fourth directions; and wherein the first angularly-extending surface of the second ear is spaced from the second angularly-extending surface of the second tab in the fifth direction. In an exemplary embodiment, the channel defines first and second angularly-extending surfaces that extend angularly inward toward each other from the second side of the plate; wherein the second angularly-extending surface is spaced from the first angularly-extending surface in a fourth direction that is generally perpendicular to each of the pivot axis and the first, second and third directions; and wherein the first and second end portions of the ridge define angularly-extending end faces, the end faces extending angularly towards each other from the first side of the plate.

An access door adapted to be pivotally coupled to a panel such as a meter box cover has been described, the access door at least partially defining a pivot axis about which the access door is adapted to pivot relative to the panel, the access door including a first surface; a second surface, wherein the second surface is axially spaced from the first surface and at least a portion of the second surface is spaced from the first surface in a first direction that is generally perpendicular to the pivot axis; a third surface; a fourth surface, wherein the fourth surface is spaced from the third surface in a second direction that is generally perpendicular to each of the pivot axis and the first direction; and an axially-extending passage defined by at least the first, second, third and fourth surfaces, the passage being generally coaxial with the pivot axis; wherein the first, second, third and fourth surfaces are integrally formed; and wherein, when a pin element extends through the passage to thereby pivotally couple the access door to the panel: the pin element extends between the first and second surfaces so that relative movement between the access door and the panel in the first direction is resisted; and the pin element extends between the third and fourth surfaces so that relative movement between the access door and the panel in the second direction is resisted. In an exemplary embodiment, the access door includes a plate defining first and second sides; a ridge extending along the first side of the plate, the ridge including the first surface and at least respective portions of the third and fourth surfaces; and a channel formed in the second side of the plate, and extending into the ridge and axially therealong to thereby define the first, third and fourth surfaces. In an exemplary embodiment, the access door includes a fifth surface, wherein the fifth surface is axially spaced from the first and second surfaces so that the first surface is axially positioned between the second and fifth surfaces, and wherein at least a portion of the fifth surface is spaced from the first surface in the first direction; wherein, when the pin element extends through the passage to thereby pivotally couple the access door to the panel, the pin element extends between the first and fifth surfaces so that relative movement between the access door and the panel in the first direction is further resisted. In an exemplary embodiment, the access door includes first and second notches formed in the first side of the plate; wherein the first and second notches define the second and fifth surfaces, respectively; wherein the first opening, the channel, and the second opening are axially positioned between the first and second notches; and wherein the passage further includes the first and second notches. In an exemplary embodiment, each of the first and second surfaces is concave; and wherein the at least a portion of the second surface is spaced from the first surface in the first direction so that the respective centers of curvature of the first and second surfaces lie generally along the pivot axis. In an exemplary embodiment, the access door includes a fifth surface, wherein the fifth surface is concave and axially spaced from the first and second surfaces so that the first surface is axially positioned between the second and fifth surfaces, and wherein at least a portion of the fifth surface is spaced from the first surface in the first direction so that the respective centers of curvature of the first, second and fifth surfaces lie generally along the pivot axis; and first and second notches formed in the first side of the plate; wherein the first and second notches define the second and fifth surfaces, respectively; wherein the first opening, the channel, and the second opening are axially positioned between the first and second notches; and wherein the passage further includes the first and second notches. In an exemplary embodiment, the access door includes first and second ears, each of which defines a first angularly-extending surface; first and second tabs, each of which defines a second angularly-extending surface; wherein the second surface defined by the first notch joins respective ends of the first angularly-extending surface of the first ear and the second angularly-extending surface of the first tab; wherein the fifth surface defined by the second notch joins respective ends of the first angularly-extending surface of the second ear and the second angularly-extending surface of the second tab; wherein the first angularly-extending surface of the first ear is spaced from the second angularly-extending surface of the first tab in the second direction; wherein the first angularly-extending surface of the second ear is spaced from the second angularly-extending surface of the second tab in the second direction; and wherein, when the pin element extends through the passage to thereby pivotally couple the access door to the panel: the pin element extends between the first angularly-extending surface of the first ear and the second angularly-extending surface of the first tab so that relative movement between the access door and the panel in the second direction is further resisted; and the pin element extends between the first angularly-extending surface of the second ear and the second angularly-extending surface of the second tab so that relative movement between the access door and the panel in the second direction is still further resisted.

A method has been described that includes manufacturing an access door adapted to be pivotally coupled to a panel via a pin element, the access door including a passage, wherein manufacturing the access door includes providing a mold; and casting the access door using the mold without a core in the mold; wherein, in response to casting the access door using the mold without a core in the mold: the passage is formed, and an end portion of the pin element is permitted to be inserted through the passage as cast to thereby pivotally couple the access door to the panel. In an exemplary embodiment, the method includes pivotally coupling the access door to the panel, the panel including axially-aligned first and second openings, wherein pivotally coupling the access door to the panel includes positioning the passage axially between the axially-aligned first and second openings; and inserting the end portion of the pin element through the first opening, the passage, and the second opening, to thereby pivotally couple the access door to the panel. In an exemplary embodiment, the mold includes first and second parts, which are adapted to engage, or at least be proximate to, each other along a part line; wherein the first part includes a first surface; and a rib extending from the first surface, the rib including a convex surface at its distal end, and first and second angularly-extending end faces that extend from the surface and angularly towards one another; wherein the second part includes a raised portion that defines a second surface; an axially-extending channel formed in the raised portion; first and second notches formed in the raised portion at opposing ends of the channel, respectively; first and second angularly-extending surfaces defined by the first and second notches, respectively; and third and fourth surfaces defined by the first and second notches, respectively, wherein the first and second angularly-extending surfaces extend from the second surface and angularly towards one another to the third and fourth surfaces, respectively; and wherein casting the access door using the mold without a core in the mold includes engaging the convex surface of the rib of the first part with the third and fourth surfaces of the second part; and engaging the first and second angularly-extending end faces of the first part with the first and second angularly-extending surfaces, respectively, of the second part. In an exemplary embodiment, in response to engaging the convex surface of the rib of the first part with the third and fourth surfaces of the second part and engaging the first and second angularly-extending end faces of the first part with the first and second angularly-extending surfaces, respectively, of the second part: a ridge is formed, the ridge including opposing first and second end portions; an axially-extending channel in the ridge is formed, the axially-extending channel defining a concave surface; a first opening is formed, the first opening extending through the first end portion of the ridge in a first direction that is generally perpendicular to the pivot axis, and also extending from the channel and through the first end portion of the ridge in a second direction that is generally parallel to the pivot axis; a second opening is formed, the second opening extending through the second end portion of the ridge in the first direction, and also extending from the channel and through the second end portion of the ridge in a third direction that is generally parallel to the pivot axis and opposite to the second direction; wherein the passage includes the channel and the first and second openings. In an exemplary embodiment, casting the access door using the mold without a core in the mold includes forming a plate; forming a ridge extending from the plate, the ridge including opposing first and second end portions; forming an axially-extending channel in the plate and the ridge; forming a first opening that extends through the plate and the first end portion of the ridge in a first direction that is generally perpendicular to the pivot axis, and that also extends from the channel and through the first end portion of the ridge in a second direction that is generally parallel to the pivot axis; and forming a second opening that extends through the plate and the first end portion of the ridge in the first direction, and that also extends from the channel and through the second end portion of the ridge in a third direction that is generally parallel to the pivot axis and opposite to the second direction. In an exemplary embodiment, the passage includes the channel and the first and second openings; and wherein the method further includes pivotally coupling the access door to the panel, the panel including axially-aligned openings, wherein pivotally coupling the access door to the panel includes positioning the passage axially between the axially-aligned first and second openings; and inserting the end portion of the pin element through one of the axially-aligned openings, the first opening, the passage, the second opening, and the other of the axially-aligned openings, to thereby pivotally couple the access door to the panel. In an exemplary embodiment, the access door further includes a plate defining first and second sides; a ridge extending along the first side of the plate, the ridge including opposing first and second end portions; a channel formed in the second side of the plate, and extending into the ridge and axially therealong; a first opening extending through the plate and the first end portion of the ridge in a first direction that is generally perpendicular to the pivot axis, and also extending from the channel and through the first end portion of the ridge in a second direction that is generally parallel to the pivot axis; and a second opening extending through the plate and the second end portion of the ridge in the first direction, and also extending from the channel and through the second end portion of the ridge in a third direction that is generally parallel to the pivot axis and opposite to the second direction; wherein the passage includes the channel, the first opening, and the second opening.

A panel to which an access door is adapted to be pivotally coupled has been described, the panel at least partially defining a pivot axis about which the access door is adapted to pivot relative to the panel, the panel including a plate defining first and second sides; a first opening formed through the plate and in which at least a portion of the access door is adapted to be disposed, the first opening defining opposed edges on the first side of the plate; first and second walls extending from the plate, the first and second walls defining first and second surfaces, respectively, the first and second surfaces being respectively generally aligned with the opposed edges defined by the first opening; a second opening extending through the plate and into the first wall in a first direction that is generally perpendicular to the pivot axis, the second opening also extending from the first opening and through the first wall in a second direction that is generally parallel to the pivot axis; a third opening extending through the plate and into the second wall in the first direction, the third opening also extending from the first opening and through the second wall in a third direction that is generally parallel to the pivot axis and opposite to the second direction; and an axially-extending passage including the second and third openings, wherein the passage is generally coaxial with the pivot axis and a pin element is adapted to extend through the passage to thereby pivotally couple the access door to the panel. In an exemplary embodiment, the second opening defines third and fourth surfaces, the fourth surface being spaced from the third surface in a fourth direction that is generally perpendicular to the pivot axis and each of the first and second directions; and wherein the third opening defines fifth and sixth surfaces, the sixth surface being spaced from the fifth surface in the fourth direction. In an exemplary embodiment, the second opening defines a seventh surface, at least a portion of the seventh surface being spaced from the second side of the plate in the first direction; and wherein the third opening defines an eighth surface, at least a portion of the eighth surface being spaced from the second side of the plate in the first direction. In an exemplary embodiment, the third and fourth surfaces extend angularly towards each other; wherein the seventh surface is generally concave and at least a portion of the seventh surface extends between respective ends of the third and fourth surfaces; wherein the fifth and sixth surfaces extend angularly towards each other; and wherein the eighth surface is generally concave and at least a portion of the eighth surface extends between respective ends of the fifth and sixth surfaces. In an exemplary embodiment, when the pin element extends through the passage to thereby pivotally couple the access door to the panel: the pin element extends between the third and fourth surfaces, and between the fifth and sixth surfaces, so that relative movement between the access door and the panel in the fourth direction is resisted; and the pin element extends between the second side of the plate and the seventh surface, and between the second side of the plate and the eighth surface, so that relative movement between the access door and the panel in the first direction is resisted.

A panel to which an access door is adapted to be pivotally coupled has been described, the panel at least partially defining a pivot axis about which the access door is adapted to pivot relative to the panel, the panel including a first surface; a second surface, wherein the second surface is axially spaced from at least a portion of the first surface, and at least a portion of the second surface is spaced from the first surface in a first direction that is generally perpendicular to the pivot axis; a third surface; a fourth surface, wherein the fourth surface is spaced from the third surface in a second direction that is generally perpendicular to each of the pivot axis and the first direction; an axially-extending passage defined by at least the first, second, third and fourth surfaces, the passage being generally coaxial with the pivot axis; wherein the first, second, third and fourth surfaces are integrally formed; wherein, when a pin element extends through the passage to thereby pivotally couple the access door to the panel: the pin element extends between the first and second surfaces so that relative movement between the access door and the panel in the first direction is resisted; and the pin element extends between the third and fourth surfaces so that relative movement between the access door and the panel in the second direction is resisted. In an exemplary embodiment, the panel includes a fifth surface, wherein the fifth surface is axially spaced from the second surface, the fifth surface is axially spaced from the at least a portion of the first surface, and at least a portion of the fifth surface is spaced from the first surface in the first direction; a sixth surface, wherein the sixth surface is axially spaced from the fourth surface; and a seventh surface, wherein the seventh surface is spaced from the sixth surface in the second direction; wherein the passage is defined by at least the first, second, third, fourth, fifth, sixth and seventh surfaces. In an exemplary embodiment, the panel includes a plate defining first and second sides; a first opening formed through the plate and in which at least a portion of the access door is adapted to be disposed, the first opening defining opposed edges on the first side of the plate, the opposed edges being spaced in a parallel relation. In an exemplary embodiment, the panel includes first and second walls extending from the plate, the first and second walls being spaced in a parallel relation, the first and second walls defining respective surfaces that are respectively generally aligned with the opposed edges defined by the first opening. In an exemplary embodiment, the panel includes a second opening extending through the plate and into the first wall in the first direction, the second opening also extending from the first opening and through the first wall in a third direction that is generally parallel to the pivot axis; and a third opening extending through the plate and into the second wall in the first direction, the third opening also extending from the first opening and through the second wall in a fourth direction that is generally parallel to the pivot axis and opposite to the third direction; wherein the axially-extending passage includes the second and third openings. In an exemplary embodiment, the second, third and fourth surfaces are defined by the second opening; and wherein the fifth, sixth and seventh surfaces are defined by the third opening.

A kit has been described that includes a panel, the panel defining a first pivot axis, the panel including a first plate; a first opening formed through the first plate, the first opening defining opposed edges of the first plate, the opposed edges being spaced in a parallel relation; first and second walls extending from the first plate, the first and second walls being spaced in a parallel relation, the first and second walls defining first and second surfaces, respectively, the first and second surfaces being respectively generally aligned with the opposed edges defined by the first opening; a second opening extending through the first plate and into the first wall in a first direction that is generally perpendicular to the first pivot axis, the second opening also extending from the first opening and through the first wall in a second direction that is generally parallel to the first pivot axis; a third opening extending through the first plate and into the second wall in the first direction, the third opening also extending from the first opening and through the second wall in a third direction that is generally parallel to the first pivot axis and opposite to the second direction; and an axially-extending first passage including the second and third openings, wherein the first passage is generally coaxial with the first pivot axis; and an access door adapted to be pivotally coupled to the panel, wherein the access door defines a second pivot axis and includes: a second plate defining first and second sides; a ridge extending along the first side of the second plate, the ridge including opposing first and second end portions; a channel formed in the second side of the second plate, and extending into the ridge and axially therealong; a fourth opening extending through the second plate and the first end portion of the ridge in a fourth direction that is generally perpendicular to the second pivot axis, and also extending from the channel and through the first end portion of the ridge in a fifth direction that is generally parallel to the second pivot axis; a fifth opening extending through the second plate and the second end portion of the ridge in the fourth direction, and also extending from the channel and through the second end portion of the ridge in a sixth direction that is generally parallel to the second pivot axis and opposite to the fifth direction; and an axially-extending second passage including the channel, the fourth opening, and the fifth opening, wherein the second passage is generally coaxial with the second pivot axis. In an exemplary embodiment, the kit includes a pin element adapted to extend through the first and second passages; wherein, when the pin element extends through the first and second passages: at least a portion of the access door is disposed in the first opening of the panel; the first passage, the second passage, the first pivot axis, and the second pivot axis are generally coaxial; and the access door is pivotally coupled to the panel so that the access door is permitted to pivot, relative to the panel and about the generally coaxial first and second pivot axes.

A method has been described that includes manufacturing a panel adapted to be pivotally coupled to an access door via a pin element, the panel at least partially defining a pivot axis about which the access door is adapted to pivot relative to the panel, the panel including first and second openings that are generally coaxial with the pivot axis, wherein manufacturing the panel includes providing a mold; and casting the panel using the mold without a core in the mold; wherein, in response to casting the panel using the mold without a core in the mold: the first and second openings are formed and are generally coaxial with the pivot axis as cast; and an end portion of the pin element is permitted to be inserted through the first and second openings as cast, the end portion being permitted to be inserted in a direction that is generally parallel to the pivot axis so that the pin element is generally coaxial with the pivot axis. In an exemplary embodiment, the method includes pivotally coupling the access door to the panel, the access door including axially-aligned third and fourth openings, wherein pivotally coupling the access door to the panel includes positioning the axially-aligned third and fourth openings axially between the first and second openings; and inserting the end portion of the pin element through the first opening, the third opening, the fourth opening, and the second opening, to thereby pivotally couple the access door to the panel. In an exemplary embodiment, the mold includes first and second parts, which are adapted to engage, or at least be proximate to, each other along a part line; wherein the first part includes a first surface; and first and second protrusions extending from the first surface, each of the first and second protrusions including first and second angularly-extending surfaces that extend angularly from the first surface and towards one another; a first convex curved surface that joins the respective distal edges of the first and second angularly-extending surfaces; and a second convex curved surface that extends angularly from the first surface and towards the first convex curved surface, the second convex curved surface joining respective edges of the first convex curved surface and the first and second angularly-extending surfaces; and wherein the second part includes first and second notches formed therein. In an exemplary embodiment, casting the panel using the mold without a core in the mold includes engaging the first protrusion with the first notch; and engaging the second protrusion with the second notch; wherein the first opening is at least partially formed in response to the engagement between the first protrusion and the first notch; and wherein the second opening is at least partially formed in response to the engagement between the second protrusion and the second notch. In an exemplary embodiment, the second part further includes a second surface; a recess formed in the second surface, the recess defining a third surface that is offset from the second surface; a channel formed in the third surface; and a raised portion surrounded by the channel, the raised portion defining a fourth surface that is generally coplanar with the second surface; wherein casting the panel using the mold without a core in the mold further includes engaging the first surface of the first part with the coplanar second and fourth surfaces of the second part; wherein a plate and a third opening extending therethrough are at least partially formed in response to the engagement between the first surface and the coplanar second and fourth surfaces, the plate defining first and second sides; wherein first and second walls are at least partially formed using the channel in response to the engagement between the first surface and the coplanar second and fourth surfaces, the first and second walls extending from the plate; and wherein the panel includes the plate, the third opening, and the first and second walls. In an exemplary embodiment, in response to casting the panel using the mold without a core in the mold: the first opening extends through the plate and into the first wall in a first direction that is generally perpendicular to the pivot axis, and also extends from the third opening and through the first wall in a second direction that is generally parallel to the pivot axis; and the second opening extends through the plate and into the second wall in the first direction, and also extends from the third opening and through the second wall in a third direction that is generally parallel to the pivot axis and opposite to the second direction. In an exemplary embodiment, the panel further includes a plate defining first and second sides; a third opening formed through the plate and in which at least a portion of the access door is adapted to be disposed, the third opening defining opposed edges on the first side of the plate; and first and second walls extending from the plate, the first and second walls defining first and second surfaces, respectively, the first and second surfaces being respectively generally aligned with the opposed edges defined by the third opening; wherein the first opening extends through the plate and into the first wall in a first direction that is generally perpendicular to the pivot axis, and also extends from the third opening and through the first wall in a second direction that is generally parallel to the pivot axis; and wherein the second opening extends through the plate and into the second wall in the first direction, and also extends from the third opening and through the second wall in a third direction that is generally parallel to the pivot axis and opposite to the second direction.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-toside," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. A panel to which an access door is adapted to be pivotally coupled, the panel at least partially defining a pivot axis about which the access door is adapted to pivot relative to the panel, the panel comprising:

a first surface;

a second surface, wherein:

the second surface is axially spaced from at least a portion of the first surface, and at least a portion of the second surface is spaced from the first surface in a first direction that is generally perpendicular to the pivot axis;

a third surface;

a fourth surface, wherein the fourth surface is spaced from the third surface in a second direction that is generally perpendicular to each of the pivot axis and the first direction;

a fifth surface, wherein:

the fifth surface is axially spaced from the second surface, the fifth surface is axially spaced from the at least a portion of the first surface, and at least a portion of the fifth surface is spaced from the first surface in the first direction;

a sixth surface, wherein the sixth surface is axially spaced from the fourth surface;

a seventh surface, wherein the seventh surface is spaced from the sixth surface in the second direction; and an axially-extending passage defined by at least the first, second, third, fourth, fifth, sixth, and seventh surfaces, the passage being generally coaxial with the pivot axis;

wherein the first, second, third, fourth, fifth, sixth, and seventh surfaces are integrally formed;

wherein, when a pin element extends through the passage to thereby pivotally couple the access door to the panel:

the pin element extends between the first and second surfaces so that relative movement between the access door and the panel in the first direction is resisted; and the pin element extends between the third and fourth surfaces so that relative movement between they access door and the panel in the second direction is resisted.

2. The panel of claim 1, further comprising:

a plate defining first and second sides;

a first opening formed through the plate and in which at least a portion of the access door is adapted to be disposed, the first opening defining opposed edges on the first side of the plate, the opposed edges being spaced in a parallel relation.

3. The panel of claim 2, further comprising:

first and second walls extending from the plate, the first and second walls being spaced in a parallel relation, the first and second walls defining respective surfaces that are respectively generally aligned with the opposed edges defined by the first opening.

4. The panel of claim 3, further comprising:

a second opening extending through the plate and into the first wall in the first direction, the second opening also extending from the first opening and through the first wall in a third direction that is generally parallel to the pivot axis; and a third opening extending through the plate and into the second wall in the first direction, the third opening also extending from the first opening and through the second wall in a fourth direction that is generally parallel to the pivot axis and opposite to the third direction;

wherein the axially-extending passage comprises the second and third openings.

5. The panel of claim 4, wherein the second, third and fourth surfaces are defined by the second opening; and wherein the fifth, sixth and seventh surfaces are defined by the third opening.

6. A kit comprising:

a panel, the panel defining a first pivot axis, the panel comprising:

a first plate;

a first opening formed through the first plate, the first opening defining opposed edges of the first plate, the opposed edges being spaced in a parallel relation;

first and second walls extending from the first plate, the first and second walls being spaced in a parallel relation, the first and second walls defining first and second surfaces, respectively, the first and second surfaces being respectively generally aligned with the opposed edges defined by the first opening;

a second opening extending through the first plate and into the first wall in a first direction that is generally perpendicular to the first pivot axis, the second opening also extending from the first opening and through the first wall in a second direction that is generally parallel to the first pivot axis;

a third opening extending through the first plate and into the second wall in the first direction, the third opening also extending from the first opening and through the second wall in a third direction that is generally parallel to the first pivot axis and opposite to the second direction; and an axially-extending first passage comprising the second and third openings, wherein the first passage is generally coaxial with the first pivot axis;

and an access door adapted to be pivotally coupled to the panel, wherein the access door defines a second pivot axis and comprises:

a second plate defining first and second sides;

a ridge extending along the first side of the second plate, the ridge comprising opposing first and second end portions;

a channel formed in the second side of the second plate, and extending into the ridge and axially therealong;

a fourth opening extending through the second plate and the first end portion of the ridge in a fourth direction that is generally perpendicular to the second pivot axis, and also extending from the channel and through the first end portion of the ridge in a fifth direction that is generally parallel to the second pivot axis;

a fifth opening extending through the second plate and the second end portion of the ridge in the fourth direction, and also extending from the channel and through the second end portion of the ridge in a sixth direction that is generally parallel to the second pivot axis and opposite to the fifth direction; and an axially-extending second passage comprising the channel, the fourth opening, and the fifth opening, wherein the second passage is generally coaxial with the second pivot axis.

7. The kit of claim 6, further comprising:

a pin element adapted to extend through the first and second passages;

wherein, when the pin element extends through the first and second passages:

at least a portion of the access door is disposed in the first opening of the panel;

the first passage, the second passage, the first pivot axis, and the second pivot axis are generally coaxial; and the access door is pivotally coupled to the panel so that the access door is permitted to pivot, relative to the panel and about the generally coaxial first and second pivot axes.

8. A panel to which an access door is adapted to be pivotally coupled, the panel at least partially defining a pivot axis about which the access door is adapted to pivot relative to the panel, the panel comprising:

a first surface;

a second surface, wherein at least a portion of the second surface is spaced from the first surface in a first direction that is generally perpendicular to the pivot axis;

a third surface;

a fourth surface, wherein the fourth surface is spaced from the third surface in a second direction that is generally perpendicular to each of the pivot axis and the first direction; and a fifth surface, wherein:

the fifth surface is axially spaced from the second surface, the fifth surface is axially spaced from the at least a portion of the first surface, and at least a portion of the fifth surface is spaced from the first surface in the first direction;

a sixth surface, wherein the sixth surface is axially spaced from the fourth surface;

a seventh surface, wherein the seventh surface is spaced from the sixth surface in the second direction; and an axially-extending passage defined by at least the first, second third, fourth, fifth, sixth, and seventh surfaces, the passage being generally coaxial with the pivot axis;

wherein the first, second, third, fourth, fifth, sixth, and seventh surfaces are integrally formed;

wherein at least one of the first, second, third, and fourth surfaces is axially spaced from at least one other of the first, second, third, and fourth surfaces; and wherein, when a pin element extends through the passage to thereby pivotally couple the access door to the panel:

the pin element extends between the first and second surfaces so that relative movement between the access door and the panel in the first direction is resisted; and the pin element extends between the third and fourth surfaces so that relative movement between the access door and the panel in the second direction is resisted.

9. The panel of claim 8, wherein the passage is corelessly integrally formed.

10. The panel of claim 1, wherein the passage is corelessly integrally formed.

* * * * *

UNITED STATES PATENT AND TRADEMARK OFFICE

CERTIFICATE OF CORRECTION

PATENT NO. : 8,931,662 B2
APPLICATION NO. : 12/985009
DATED : January 13, 2015
INVENTOR(S) : Earl Terence Bradley It is certified that error appears in the above-identified patent and that said Letters Patent is hereby corrected as shown below:

On the title page item (73), change Assignee name to -- EBAA Iron, Inc., Eastland, TX (US) --.

Signed and Sealed this
Eighth Day of March, 2016

Michelle K. Lee

Michelle K. Lee
*Director of the United States Patent and Trademark Office*